US005906372A

United States Patent [19]

Recard, Jr.

[11] Patent Number: 5,906,372

[45] Date of Patent: May 25, 1999

[54] TESSELLATING BOARD GAME

[76] Inventor: Richard H. Recard, Jr., P.O. Box 4082, Boulder, Colo. 80306-4082

[21] Appl. No.: 08/900,364

[22] Filed: Jul. 12, 1997

Related U.S. Application Data

[ 60] Provisional application No. 60/021,604, Jul. 12, 1996.

[51] Int. Cl.[6] ..... A63F 3/00

[52] U.S. Cl. ..... 273/253; 273/283; 273/256

[58] Field of Search ..... 273/250, 253, 273/283, 256

[56] References Cited

U.S. PATENT DOCUMENTS

| | | | |
|---|---|---|---|
| 3,223,420 | 12/1965 | Turner | 273/253 |
| 4,157,184 | 6/1979 | Recard, Jr. | 273/253 |
| 4,570,939 | 2/1986 | Tourville et al. | 273/253 |

FOREIGN PATENT DOCUMENTS

| | | | |
|---|---|---|---|
| 2139510 | 11/1984 | United Kingdom | 273/253 |

OTHER PUBLICATIONS

"Cosmic Encounter", EON Products, Inc., Games Masters Catalog, Boyton & Associates, Inc., p. 45, Sep. 1985.

"Betelgeuse", Philip Zweig, Games Magazine, Feb., 1986, p. 50, Feb. 1986.

*Primary Examiner*—Benjamin H. Layno

[57] ABSTRACT

A tessellating board game which combined with game rules simulates the economic development of single or multiple star planetary systems in which choices made by competing parties influencing each other's economic prospects have ramifications modeled by a subsuming moral dynamic, affecting player destiny as moral or karmic law analogous to natural law. Also simulated is a complex gravitational field of a star and its planets, either for a single star in the unistellar game version or for multiple stars in the multistellar game version, and players must plot spacecraft trajectories within those gravitational fields, adjusting spacecraft speed and direction using planetary encounters and fuel decrement, and, in the multistellar game, using hyperspace jump locations to transcend the constraint of distance.

21 Claims, 29 Drawing Sheets

18
19
21
15
20
17
16

Example of spacecraft positioning against hexagon side showing final motion direction.

Two examples of forbidden hexagon traverses.

Two examples of forbidden hexagon traverses.

Inner or Middle Planet traverses for spacecraft in parabolic orbit.

Illustrated are the three permissible initial positions (orientations to planet) and the five resulting Speed increments or decrements.

*Figure 18C*

| Enumeration | Explanation |
|---|---|
| A | Star traverse from Ring 1 hexagon at 1 to hexagon at 2 demonstrating use of rays to identify opposite hexagon. |
| B | Star traverse from Ring 1 hexagon at 3 to hexagon at 4 demonstrating use of spaces between rays to identify opposite hexagon. |
| C,D | Oppositely positioned heptagons. |
| E,F | Oppositely positioned Ring 7 hexagons. |
| G,H | Oppositely positioned Ring 5 hexagons. |

NOTE: spacecraft drawn smaller than scale

Figure 19B

| Orbit Transition Type | Enumeration | Speed Units Decremented | Fuel Units Decremented |
|---|---|---|---|
| (1) circular to parabolic | a1, a2, a3, a4 | 1 | 1 |
| (2) parabolic to circular | b1, b2, b3, b4 | 1 | 1 |
| (3) parabolic to parabolic | c1, c2, c3, c4 | 2 | 2 |
| (4) parabolic to paracircular (clockwise type only show); | d1 | 0 | 0 |
| (5) paracircular to parabolic (counterclockwise type only show); | d2 | 0 | 0 |

*Figure 20B*

A Portion of Interboard Region With Depiction of Penalized Orbital Transition Types

This diagram depicts all types of interboard hexagon traversal (all motions onto or off the interboard hexagons created when two or three game boards are tessellated) that require decrements of one Fuel and one Speed unit. These different types of orbital transition are identified with different letters, but they are identically governed by the rule (Section 1.5.4, Part B {page 26}) requiring Fuel and Speed decrement of one unit. All interboard hexagon traversals not depicted require no Fuel or Speed alteration; because they are not considered orbital transitions, but constant trajectories.

Motions c11, c12, and d2 are onto hexagons that are not drawn in order to maintain the overall figure's symmetry while limiting its height.

The central interboard hexagon labeled HJ is the Hyperspace Jump point (requiring for its creation the trinary star configuration) described in Section 1.5.8.

Another example of an interboard hexagon is labeled IH. The Ring 7 hexagon labeled R is one of the six

*Figure 21B*

Planet traverses for spacecraft entering or leaving interboard region and approaching Outer Planet across a heptagon.

Illustrated are the four initial positions (orientations of spacecraft to planet) -b1, b2, c1, c2-and five planet traverses -d1, d2, e1, e2, e3- with the resulting Speed and Fuel increments and decrements. Two of the initial positions -b1, b2- are components of trajectories beginning at interboard Stages 3 positions -a1, a2- and it is assumed that on the round of play beginning with the planet occupying the position depicted either (1) spacecraft occupy positions b1 and b2 or (2) spacecraft in the interboard positions a1 and a2 have Speed sufficient to attain positions b1 and b2 with two polygon traverses remaining. It is further assumed that on the round of play beginning with the planet occupying the position depicted either (1) spacecraft occupy positions c1 and c2 or (2) spacecraft in the intraboard region have Speed sufficient to attain positions c1 and c2 with two polygon traverses remaining. Four trajectories -traversing positions b1, b2, c1, c2- succeed to interboard Stage 1 positions -d1, d2. For Stage 3 positions a1,a2 there are also depicted using dashed lines the three permitted paths originating from Stage 1 positions. Dotted lines are trajectories leaving or entering the interboard region.

The following table gives for each planet traversing trajectory, identified by couplets of form "b1 to d1", the portion of a spacecraft turn required to complete that trajectory, the final spacecraft position at turn end, and the rules governing that spacecraft move.

Figure 21C

| TRAJECTORY | PORTION OF TURN REQUIRED TO COMPLETE TRAJECTORY | FINAL POSITION AT TURN END | RULES GOVERNING MOVE |
|---|---|---|---|
| b1 or b2 to d1 or d2 | all of one turn, regardless of spacecraft Speed | d1 or d2 | Section 1.5.7′ |
| c1 or c2 to d1 or d2 | all of one turn, regardless of spacecraft Speed | d1 or d2 | Section 1.5.7′ |
| b1 or b2 to e1 or e2 or e3 | all of one turn if spacecraft Speed equals 2 and part if Speed greater than 2 | position e1 or e2 or e3 if Speed equals 2, or beyond if Speed greater than 2 | Section 1.4.3 |
| c1 or c2 to e1 or e2 or e3 | all of one turn if spacecraft Speed equals 2 and part if Speed greater than 2 | position e1 or e2 or e3 if Speed equals 2, or beyond if Speed greater than 2 | Section 1.4.3 |

TESSELLATING BOARD GAME

CROSS-REFERENCES TO RELATED APPLICATIONS

The essential features of the game apparatus are the subject of Provisional Patent Application #60/021,604, filed Jul. 12, 1996.

BACKGROUND OF THE INVENTION

A. Field of the Invention

The invention relates to a game apparatus simulating the economic development of single or multiple star systems, requiring the plotting of spacecraft trajectories in those single or multiple systems' combined gravitational fields of star and orbiting planets, subject to the constraint upon player economic choices of a universal moral or karmic order, generating synergy between the players' advancement of each's economic interests and the players' sacrifices for the advancement of others.

B. Prior Art

Games preexisting the present invention vary in the degree that they share features of at least two of the present invention's three distinct components —spacecraft navigation, economic competition, and moral dynamic— and no preexisting game incorporates features of all three said components.

Games involving spacecraft movement over tessellated game boards occur periodically in the market place, their availability being ephemeral, the games often linked to transitory film and television entertainment. In relation to those products, only the present inventor's previous patents U.S. Pat. No. 4,157,184 and Des. Pat. Nos. 247,453, 250, 053, and 252,049 realize game apparatus whose interrelation of game rules and polygonal tessellation enable the intuitive and tractable plotting of spacecraft trajectories in the complex gravitational fields of a star and its orbiting planets. And yet, the aforementioned game apparatus only simulate the gravitational fields of a single star and its planets, which limitation the present invention overcomes with a tessellating game board that enables simulation of multiple star planetary systems.

The field of tessellating game boards includes three recent patents which to varying degree approach the present invention in their intent. O'Conner's 1986 "Interchangeable Game Board", U.S. Pat. No. 4,614,344, demonstrates three game boards with the shapes of regular polygons each of which tessellate with congruent game boards and each of which "has an overall pathway design that differs with each arrangement of the congruent game board segments". The pathway designs for different arrangement of congruent game board segments must "differ" or those arrangements would defeat the invention's purpose of overcoming "the sameness of the unchanging and unchangeable network of pathways from one playing of a particular game to the next", which games are of the labyrinth or maze variety. O'Conner's invention's constraint to labyrinth or maze games is realized in its independent claim, which includes game board surfaces "having depicted thereon a labyrinth pathway design whereby the pathway design is a network of individual pathways" and also "at least one of said labyrinth pathway designs further include at least one cul-de-sac pathway". The independent claim also specifies that between adjacent game boards labyrinth paths are formed using entry/exit points that are at the same spaced locations on all sides of the game board segments. Thus, (1) paths that are allowed between adjacent game boards differ in their extensions within game boards (internal paths) for every distinct conjoining of game board sides,
(2) movement between two adjacent game boards is not allowed at every conjunction of those game boards' internal paths, and
(3) some of those pathways within game boards (internal paths) are closed.

Alternatively, the interconnection of multiple, spherically symmetric stellar gravitational fields is cross-sectionally simulated by the present invention's game board using a tessellation that extends between any two adjacent game boards without interruption the internal polygonal paths of one into the identical internal polygonal paths of the other. Thus, (1) paths interconnecting adjacent game boards are identical for any two game board sides conjoined,
(2) paths of adjacent game boards are not interrupted where they conjoin at their game boards' boundaries, and
(3) paths within a game board are not differentiated by interruption, and therefore none are closed.

Saiz's 1994 "Board for the Playing of Multiple Board Games", U.S. Pat. No. 5,303,930, demonstrates a board "composed of an indeterminate number of modules, each one formed by a large number of blocks which surround another block which makes up the center or nucleus of each module, and all of them are differentiated among themselves using color". Thus, the game board characteristic of modular construction that participates in the tessellation concept is circumscribed by (1) the fundamentally indivisible building module being composed in every instance of a nucleus block surrounded by other blocks, (2) "said surrounding blocks exhibiting different colors that differentiate them by pairs of blocks not adjacent to one another" and the nucleus block colored differently than the surrounding blocks, and (3) the color pattern of blocks within a module being identical for all modules. None of these characteristics is shared by the present invention.

Somerville's 1989 "Game Board", U.S. Pat. No. 4,828, 268, demonstrates a plurality of congruent game board segments which are tessellated to construct a composing game board, but each segment is distinguished by indicia representing physical objects such as cities, railroads, etc. and none has an internal tessellation.

Games realizing moral themes, whether instruction or dynamic, are rare compared to strategy games. Neff's 1982 "Board Game With Interrelated Cards and Chips", U.S. Pat. No. 4,359,226, embodies the karma concept of repayment in future lives for deeds done in past lives. The game board incorporates a circuit of positions which landed upon require a player to "elect" between a good karma instruction that causes a short term disadvantage and a long term advantage and a bad karma instruction that causes a short term advantage and a long term disadvantage. Thus, a player's karmic or moral circumstance derives from the player's choice to parameterize their unfolding economic prospects in terms of short term and long term advantage. Players do not derive their karmic or moral circumstance from choices they make regarding other players, which would correspond to karma working in the real world.

Masakayan's 1996 "Good News Bible Board Game", U.S. Pat. No. 5,529,308, "teaches spiritual principles as disclosed in the Bible". Players advance upon a board depicting the "tree of life" according to their response to predetermined questions. Thus, there is no interaction between players which manifests moral principles or influences moral destiny modeled by the game.

Munn et al.'s 1983 "Conquest Game", U.S. Pat. No. 4,385,765, combines a spacecraft travel game with an embodiment of a hidden influence in the form of astrological destiny. Herein, the solar system spacecraft traverse is partitioned between the twelve zodiacal sectors, and players receive destiny cards enhancing or diminishing their prospects within designated sectors. Again, the quasi-spiritual astrological influence is static, being contingent upon random selection and not player choice.

Games realizing economic competition are abundant. Tourville's 1986 "Board Game", U.S. Pat. No. 4,570,939, combines in the context of solar system conquest financial and martial features. The game board incorporates distinctly segregated pathways for financial, military, and planetary strategies. Players travel the outermost financial pathways buying industries to achieve what is required to advance to purchasing planet segments, in a pathway interior to the financial pathway, from which they can launch spaceships to establish dominant ownership of planets, which are motionless in their domain. No component of the present invention corresponds to those distinct financial, military, and static planet pathways.

Finally, there is the present inventor's 1979 "Game Apparatus", U.S. Pat. No. 4,157,184, in which the game board articulates within a regular hexagon tessellation a central region of concentrically inscribed rings of contiguous hexagons, wherein spacecraft trajectories in the external regular hexagon tessellation conform to rules modeling inertia and spacecraft trajectories in the concentric ring region conform to rules modeling both inertia and the complex gravitational field of a star with orbiting planets. The 1979 "Game Apparatus" is henceforth referenced Galactiad, the name used in the 1979 "Description of the Preferred Embodiments" section. The present invention shares with Galactiad an underlying navigation component, and features of the two navigation components may be partitioned between those having superficial similarity and those without similarity. Of the superficially similar features, the present invention's features are unique in the following ways:

(1) Its game board supports traversal of the central star figure using any of the forty eight possible parabolic trajectories (twenty four approaching the star figure with a clockwise curl and twenty four approaching with a counter clockwise curl); which forty eight traversals are traced using the star figure's twelve rays and twelve spaces between rays FIG. 2B-#1,#2 —missing on the Galactiad game board— and twenty four ring 1 hexagons FIG. 18B —also missing in Galactiad;

(2) Its array easel has a fourth ledge FIG. 5A-#31D upon which are placed fuel markers FIG. 6C designating the fuel supply of the spacecraft marker in whose array column it resides; which fourth array ledge and fuel markers are not present in Galactiad;

(3) Its game rules specify with detailed diagrams, FIGS. 19A,B and FIGS. 20A,B for example, (a) the amounts of fuel which must be expended to transition a spacecraft marker's orbit between circular, parabolic, and paracircular varieties and (b) changes in a spacecraft marker's speed given fuel expenditure and orbit transition type; which detailed statement of the interrelations between fuel expenditure, speed, and orbit transition are not present in Galactiad;

(4) Its game rules specify with detailed diagrams, FIG. 17 and FIG. 21A,B,C for example, (a) the initial orientations of a spacecraft marker to a polygon bearing a planet marker that permit the spacecraft marker to traverse the planet marker, (b) the permitted planet traversal trajectories, and (c) changes in speed attendant each traversal trajectory;

(5) Its game rules specify with a detailed diagram the increments to a spacecraft marker's fuel marker attendant the varied trajectories with which the spacecraft marker may traverse an outer planet marker (source of spacecraft marker fuel);

Features of the present invention's navigation component that have no (superficially) similar counterparts in Galactiad include the following 6 through 11:

(6) The multistellar game board has a region of regular hexagons —termed an interboard region— formed at the boundary of conjoined game boards that models interstellar space in the game rules governing its traversal by spacecraft markers;

(7) Game rules specify with detailed diagrams (a) the stages of spacecraft marker traversal of interboard regular hexagons, including the coordination of moves of spacecraft markers occupying the same said hexagon, and p1 (b) trajectory changes permitted upon said interboard hexagons and the speed decrements attendant such changes;

(8) Game rules specify with detailed diagrams for a spacecraft marker commencing a planet marker traversal from an interboard hexagon initial position, (a) the permitted said interboard hexagon initial planet traversal positions, (b) the permitted planet traversal trajectories, and (c) changes in speed attendant each traversal trajectory;

(9) Game rules symmetrical to "8" above that specify with detailed diagrams for a spacecraft marker commencing a planet marker traversal from an intraboard polygon (a polygon in a game board interior) with a trajectory terminating for that move on an interboard hexagon (a) the permitted said intraboard polygon initial planet traversal positions, (b) the permitted planet traversal trajectories, and (c) changes in speed attendant each traversal trajectory;

(10) Game rules specifying stable planet marker orbits —requiring no fuel expenditure to maintain— encompassing multiple game boards;

(11) Game rules specifying hyperspace jump locations and moves initiated thereon which enable spacecraft markers to traverse polygonal paths spanning multiple game boards in a single step;

The present invention, apart from navigation component considerations, uniquely differs from Galactiad with regard to the following additional features:

(1) game boards (both enumerated and unenumerated), (2) array easels, (3) game markers, (4) game rules, and (5) criteria for winning;

which differences are specified in the following Description of Preferred Embodiments section.

SUMMARY OF THE INVENTION

The object of the invention is to provide an intellectually stimulating simulation of the economic development of single or multiple star planetary systems in which choices made by competing parties influencing each other's economic prospects have ramifications modeled by a subsuming moral dynamic, affecting player destiny as moral or karmic law analogous to natural law. Also simulated is a complex gravitational field of a star and its planets, either for a single star in the unistellar game version or for multiple stars in the multistellar game version, and players must plot spacecraft trajectories within those gravitational fields, adjusting spacecraft speed and direction using planetary encounters and fuel decrement, and in the multistellar game using hyperspace jump locations to transcend the constraint of distance.

DESCRIPTION OF THE DRAWINGS

FIG. 18C is the text occurring in the game rules that explains the enumeration's of FIGS. 18A and 18B.

FIG. 19B is the text occurring in the game rules that explains the enumeration of FIG. 19A.

FIG. 20B is the text occurring in the game rules that explains the enumeration of FIG. 20A.

FIG. 21B is the text occurring in the game rules that explains the enumeration of FIG. 21A.

FIG. 21C is the table occurring in the game rules that compliments the text displayed in FIG. 21B.

DESCRIPTION OF THE PREFERRED EMBODIMENTS

I. The Game Board and Its Tessellations With Additional Game Boards

Figure 1:
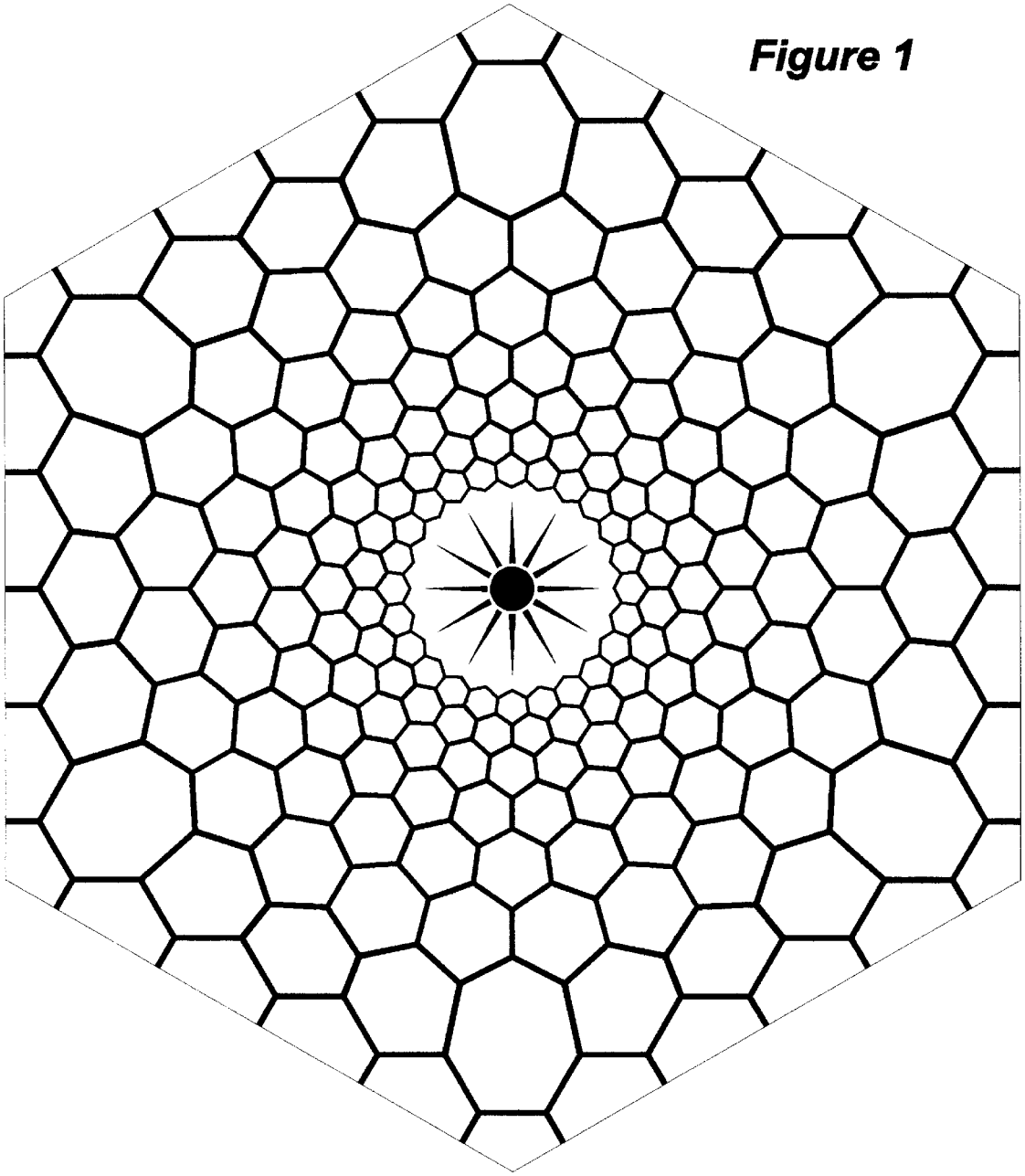
FIG. 1 illustrates the game board according to the preferred embodiment of the present invention.
Figure 3:
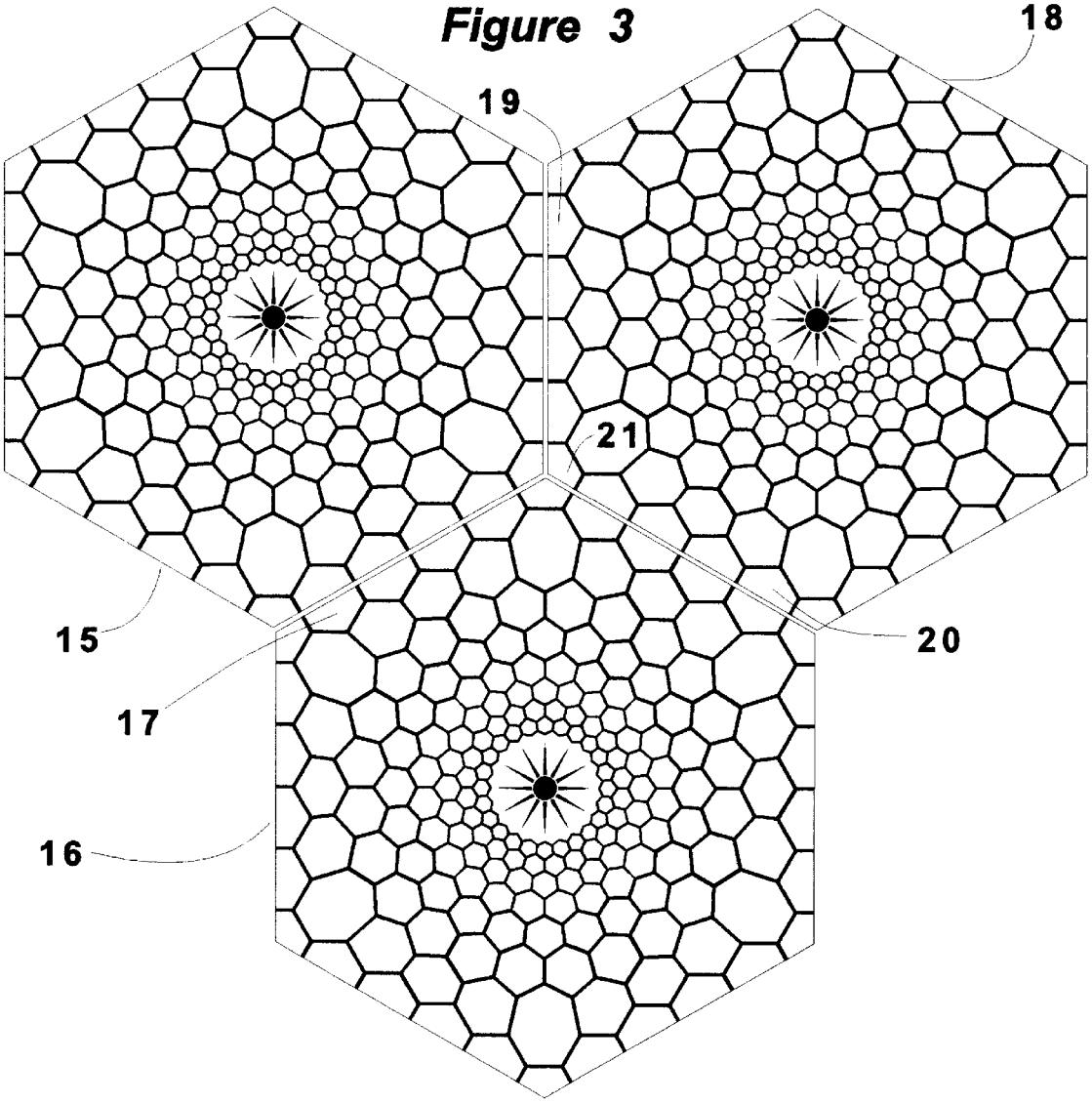
FIG. 3 illustrates three tessellated game boards, the three rows of regular hexagons their boundary polygons form, and those row's intersection at a common regular polygon.

Illustrated in FIG. 1 is the regular hexagon shaped game board, comprised of a central figure depicting a star 1 surrounded by rays 2, which star figure's center is the common center of concentric rings of contiguous hexagons —of which 3 is the innermost— the outermost which ring 4 contains six equiangularly positioned heptagons 5, and which outermost ring tessellates with linearly contiguous polygons 6 which tessellate the game board's six sides. The interior and two sides 7 of each said linearly contiguous polygon extend to a game board's edge, which edges have no line indicia to demarcate them. This single game board is used in the unistellar game version. However, the aforementioned linearly contiguous polygons tessellating the game board's sides are proportioned so that when two congruent game boards FIG. 3-#15,#16 are positioned adjacently (aligning vertex to vertex any side of one to any side of the other), the linearly contiguous polygons of one conjoin with those of the other to form a row of regular hexagons 17. When a third game board 18 is configured with two such that each game board shares an edge with two others that share an edge with each other there is formed two additional regular hexagon rows 19,20 and the three rows intersect at a common hexagon 21, which is termed a hyperspace jump location. The three regular hexagon rows are said to form the interboard region, simulating interstellar space. The region internal to each game board is termed the intraboard region, simulating the planetary region of a star's gravitational field. Three or more game boards configured as described are used in the multistellar game version.

II. The Spacecraft Markers

Figure 4:
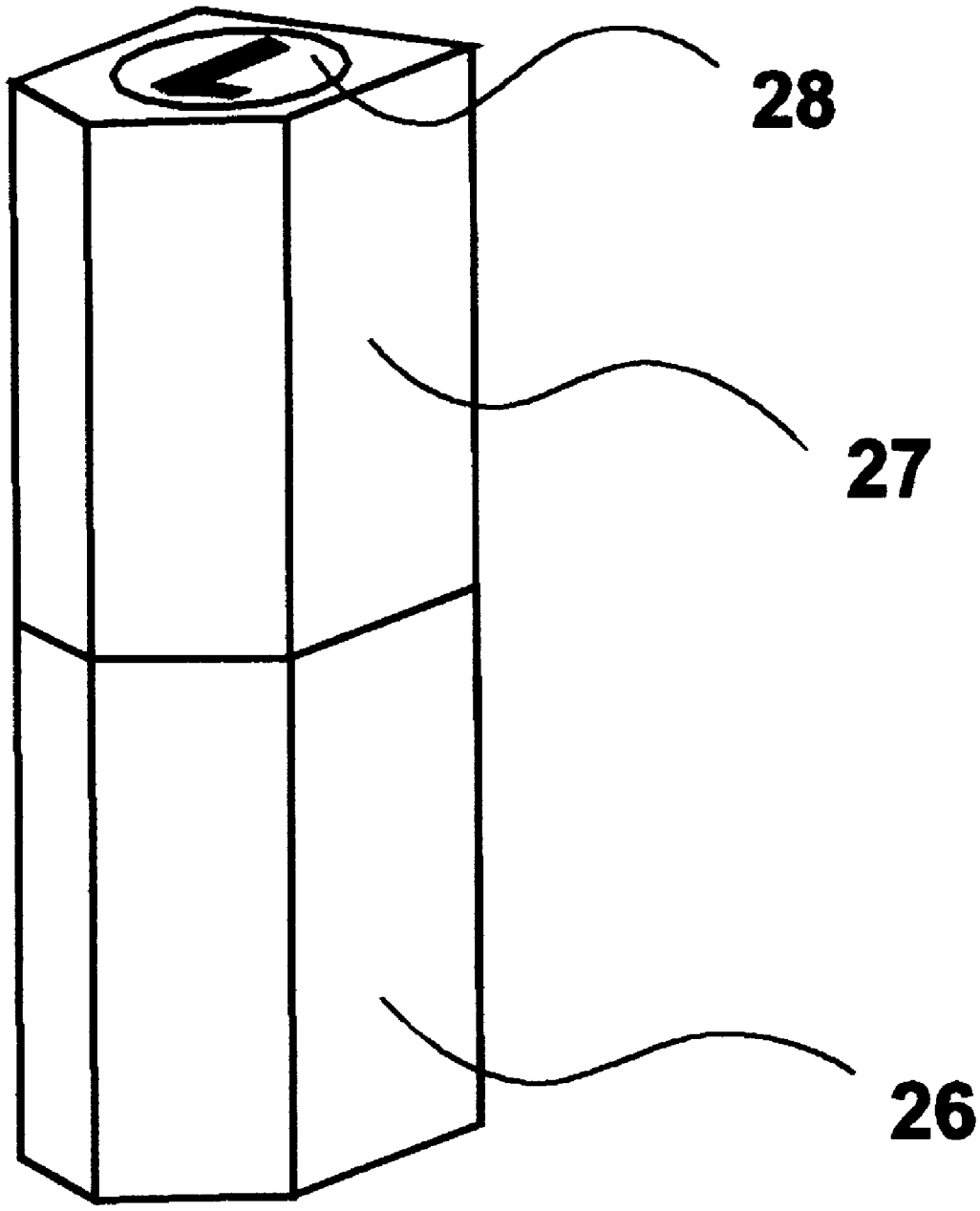
FIG. 4 illustrates one embodiment of a spacecraft game marker.

Illustrated in FIG. 4 is one embodiment of the invention's spacecraft marker, composed of lower region 26 colored according to spacecraft class, upper region 27 colored according to spacecraft player, and numeral 28. There are three spacecraft classes —primary, secondary, and tertiary— designated with black, silver, and gold coloring, respectively. The unistellar game is played by two to four players, and therefore the spacecraft markers for that game set are differentiated by four distinct player colors. In the multistellar game set there are twelve distinct player colors. In either game, each player receives spacecraft markers consisting of three spacecraft markers of each of the three classes, making nine spacecraft markers the total a player may bring into play. Player spacecraft markers of the same class are distinguished by numerals 1, 2, and 3. For brevity spacecraft markers will henceforth be referred to as spacecraft.

III. The Array Easel and Its Spacecraft Column

Figure 5A:
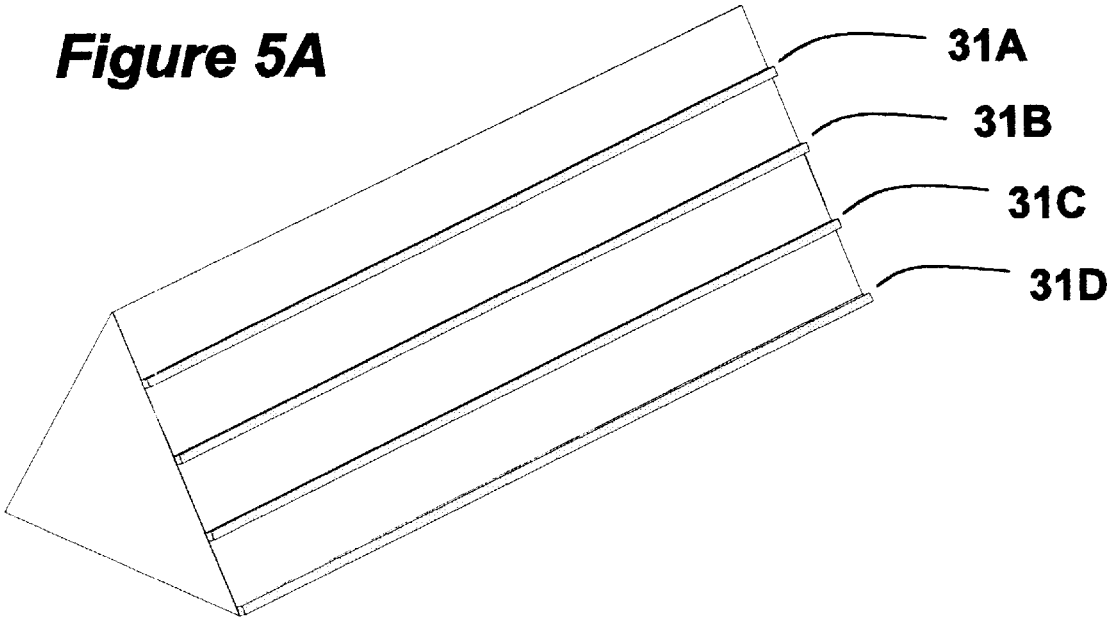
FIG. 5A illustrates an easel for displaying spacecraft identity markers, speed markers, fuel markers, resource markers, Grace markers, and three knowledge category markers.

Illustrated in FIG. 5A is an easel, termed in the game rules an array, with four ledges 31A,31B,31C,31D. Each player is distributed an array, whose function is to display for each of that player's spacecraft in play upon the game board a spacecraft identity marker FIG. 6A with the color 41 of that spacecraft's class and the spacecraft's numeral 42, which marker is positioned on the array's topmost ledge 31A. Immediately below the spacecraft identity marker on the array's second ledge 31B is positioned a speed marker FIG. 6B distinguished by numeral 43 and color 44, Immediately below the speed marker on the array's third ledge 31C is positioned a fuel marker FIG. 6C distinguished by numeral 45 and color 46. The array's fourth ledge 31D is reserved for resource markers, designating cargo, which are described below. Markers aligned vertically upon the four ledges constitute what is termed a spacecraft column, which identifies for an individual spacecraft its speed, fuel, and cargo.

IV. Example of Configured Array and the Home Station

Figure 5B:
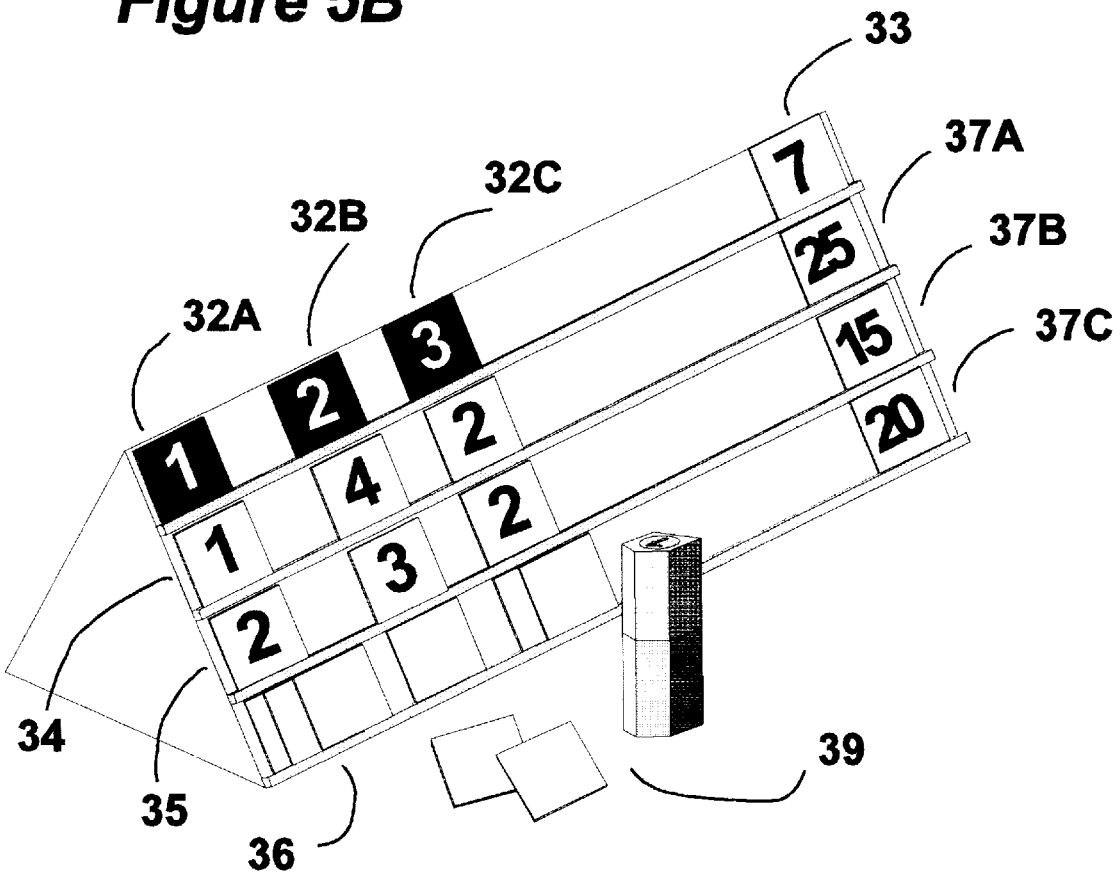
FIG. 5B illustrates an easel with spacecraft identity markers, speed markers, fuel markers, resource markers, Grace marker, and three knowledge category markers positioned upon its ledges. In front of the easel is depicted a home station containing a spacecraft marker and two resource markers.

Illustrated in FIG. 5B is an array configured with Grace marker 33, three knowledge category markers 37A,37B, 37C, and arbitrary classed spacecraft identity markers with numerals 1, 2, and 3 32A,32B,32C. In the column of the spacecraft identity marker with numeral 1 32A are speed marker with numeral 1 34, fuel marker with numeral 2 35, and three resource markers 36. Spacecraft identity markers with numerals 2 and 3 also have columns with respective speed, fuel, and resource markers. The area in front of an array is termed a home station, which is used for the deposit of spacecraft and resource markers until they are used and which a spacecraft accesses when it lands upon the seventh ring heptagon its player has selected for that purpose at a game's beginning, designating it their home station heptagon. Deposited in the home station depicted 5B-#39 are one spacecraft and two resource markers.

V. The Planet Markers and Their Associated Resource Markers

Figure 2A:
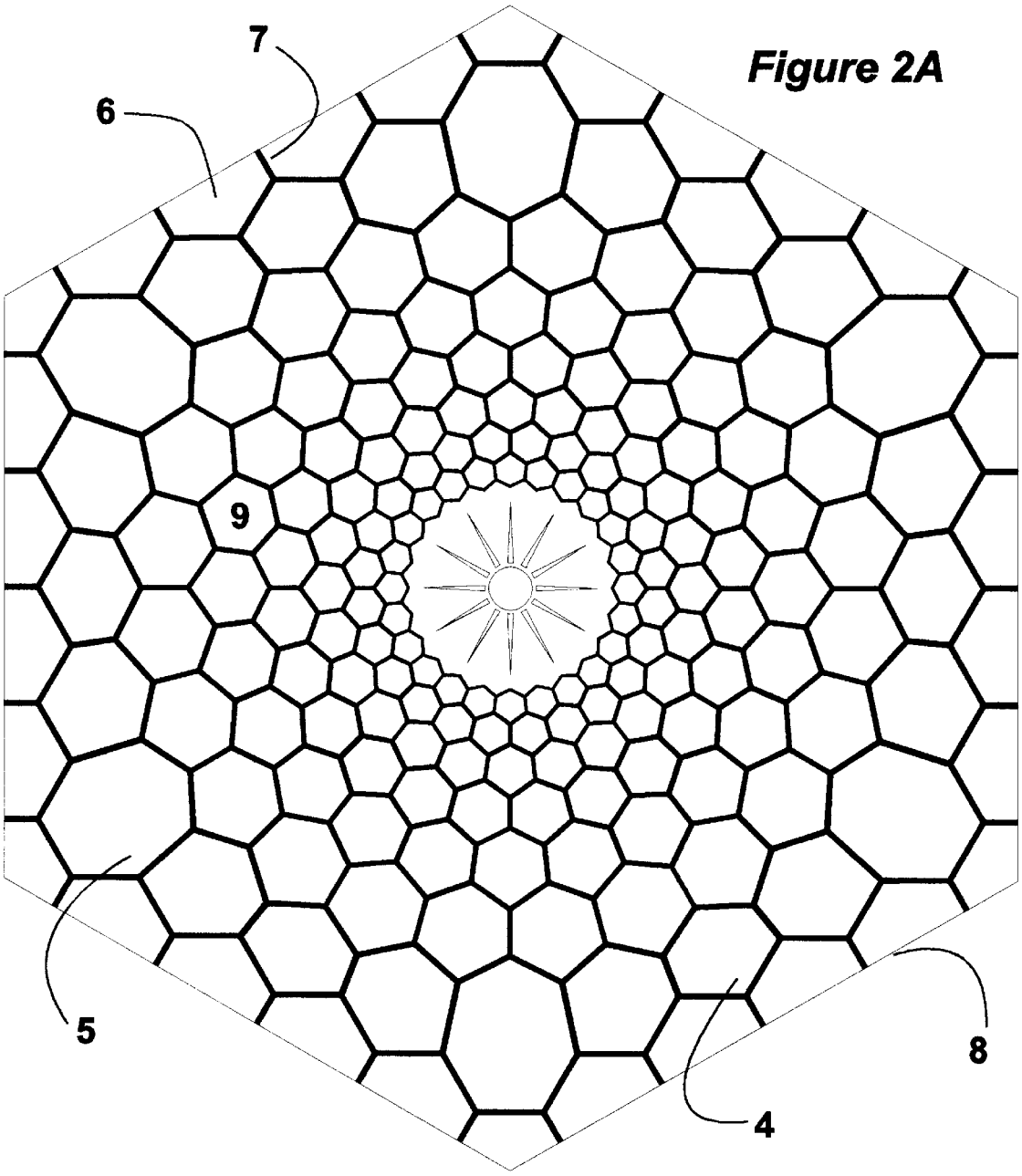
FIG. 2A illustrates game board features which establish its ability to project paths from one game board's concentric rings of contiguous polygons to a tessellating game board's concentric rings of contiguous polygons.
Figure 2B:
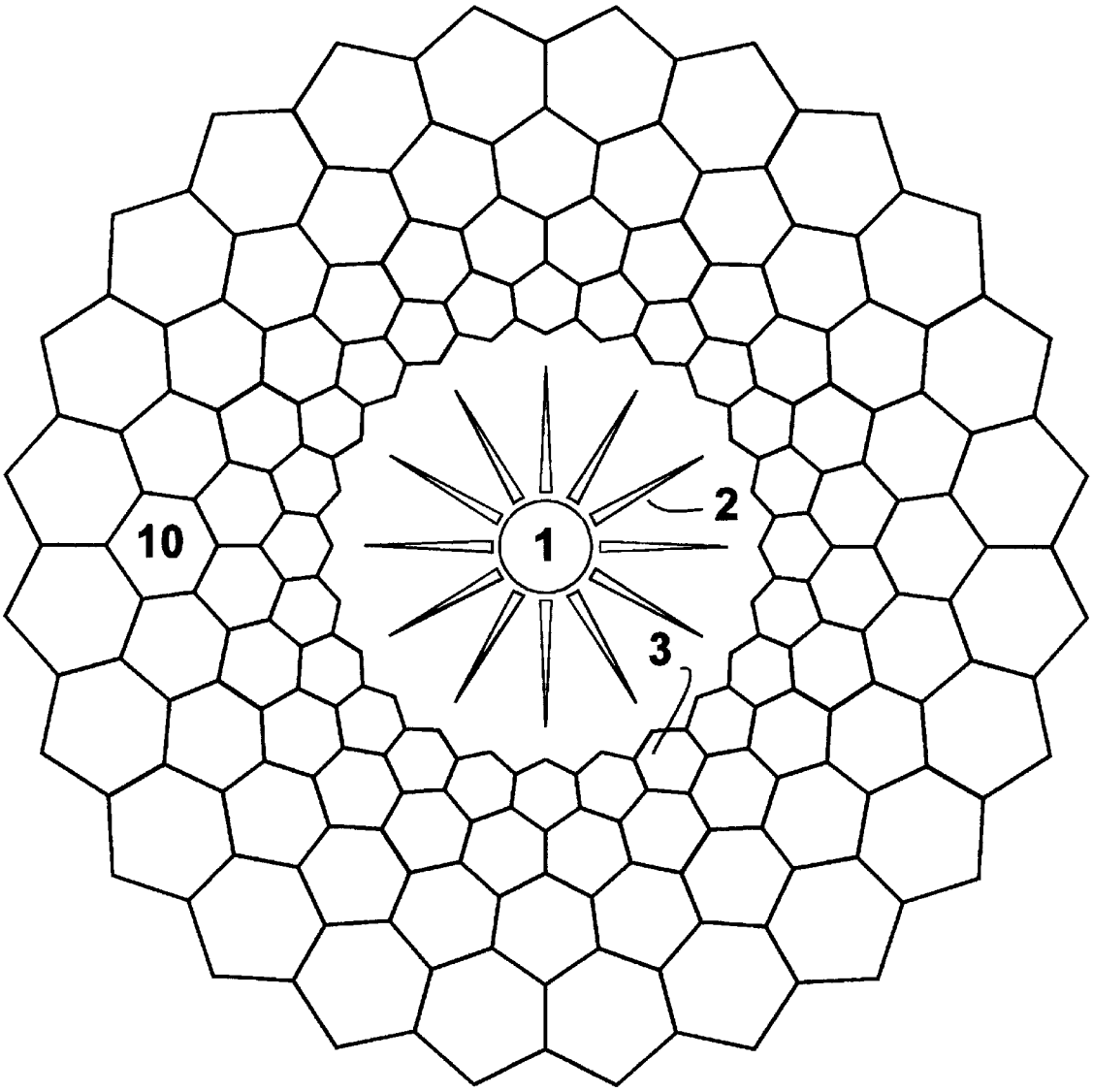
FIG. 2B is a sectional view of FIG. 2A that illustrates the innermost four rings and features of the central star figure.
Figure 7A:
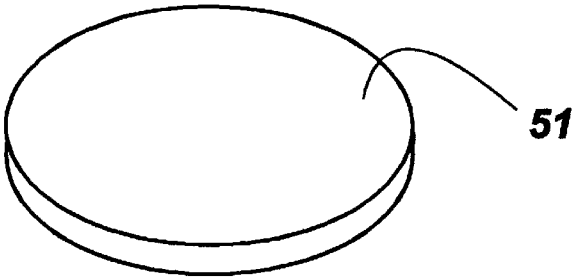
FIG. 7A illustrates an outer planet marker.
Figure 7B:
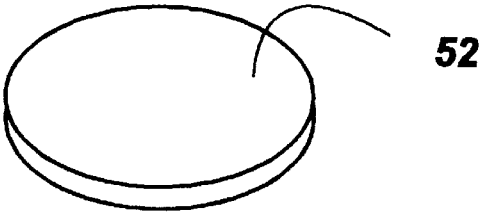
FIG. 7B illustrates a middle planet marker.
Figure 7C:
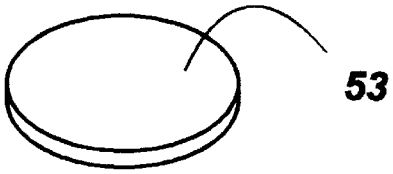
FIG. 7C illustrates an inner planet marker.
Figure 8A:
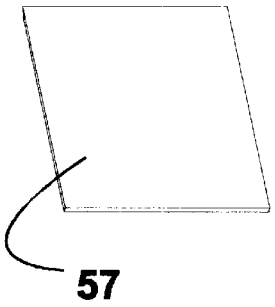
FIGS. 8A, 8B, and 8C illustrate resource markers of three respective varieties.
Figure 8B:
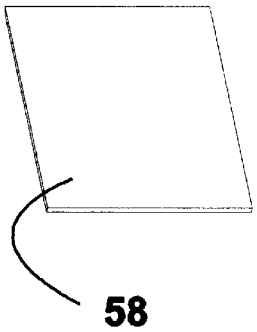
Figure 8C:
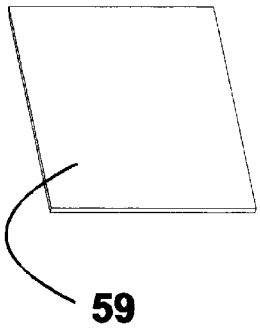

Planet markers are disks FIGS. 7A,7B,7C with diameters varying according to the size of hexagons composing the ring within which each advances, the markers distinguished by their surfaces' color and indicia 51,52,53. Two outer planet markers advance positioned opposite one another in ring 7 FIG. 2A-#4. Two middle planet markers advance positioned opposite one another in ring 5 FIG. 2A-#9, and one inner planet marker advances in ring 3 FIG. 2B-#10. Associated with each planet marker is a resource marker. The two outer planet markers are sources of spacecraft fuel. The aforementioned fuel marker numeral indicates a spacecraft's fuel supply. In the future scenario simulated by the game one middle planet is source of the energy resource required for the engineering development of societies, described below, and therefore one unit of that energy cargo is represented by one energic resource marker FIG. 8A. The second middle planet is source of life sustaining substances such as oxygen and water required for the habitation of societies, and therefore one unit of that ecological cargo is represented by one ecologic resource marker FIG. 8B. The inner planet is source of mineral resources such as metals and nonmetal elements required for the engineering development of societies, and therefore one unit of that mineral cargo is represented by a mineral resource marker FIG. 8C. All three resource markers are rectangular shaped and scaled to fit on an array ledge, and each is distinguished from the other by color and indicia on a surface 57,58,59.

VI. The External Planet Marker

Figure 9:
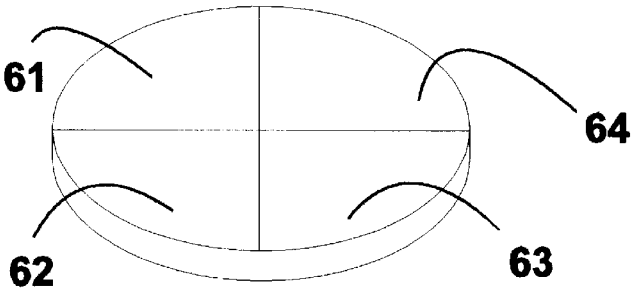
FIG. 9 illustrates an external planet marker.

Associated with each planet marker is an external planet marker FIG. 9, partitioned into four areas 61,62,63,64, one area for each player, and of sufficient size to contain within each player's partition their accumulation of society markers, described below, and resource markers. As the name implies, external planet markers are positioned off the game board. For brevity, planet markers will henceforth be referred to as planets.

VII. Hyperspace Jump Locations and Markers

Figure 22:
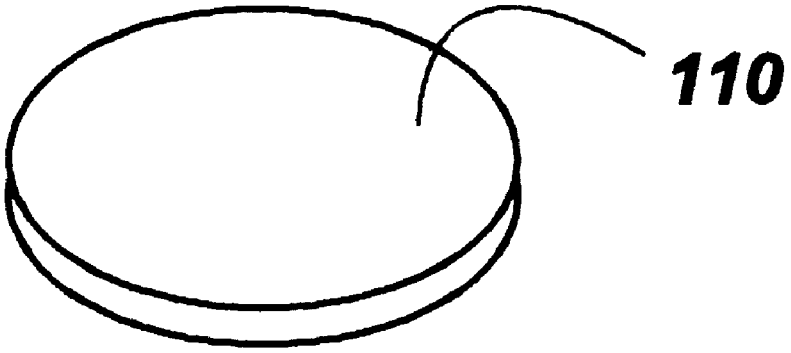
FIG. 22 illustrates a hyperspace jump marker.
Figure 24:
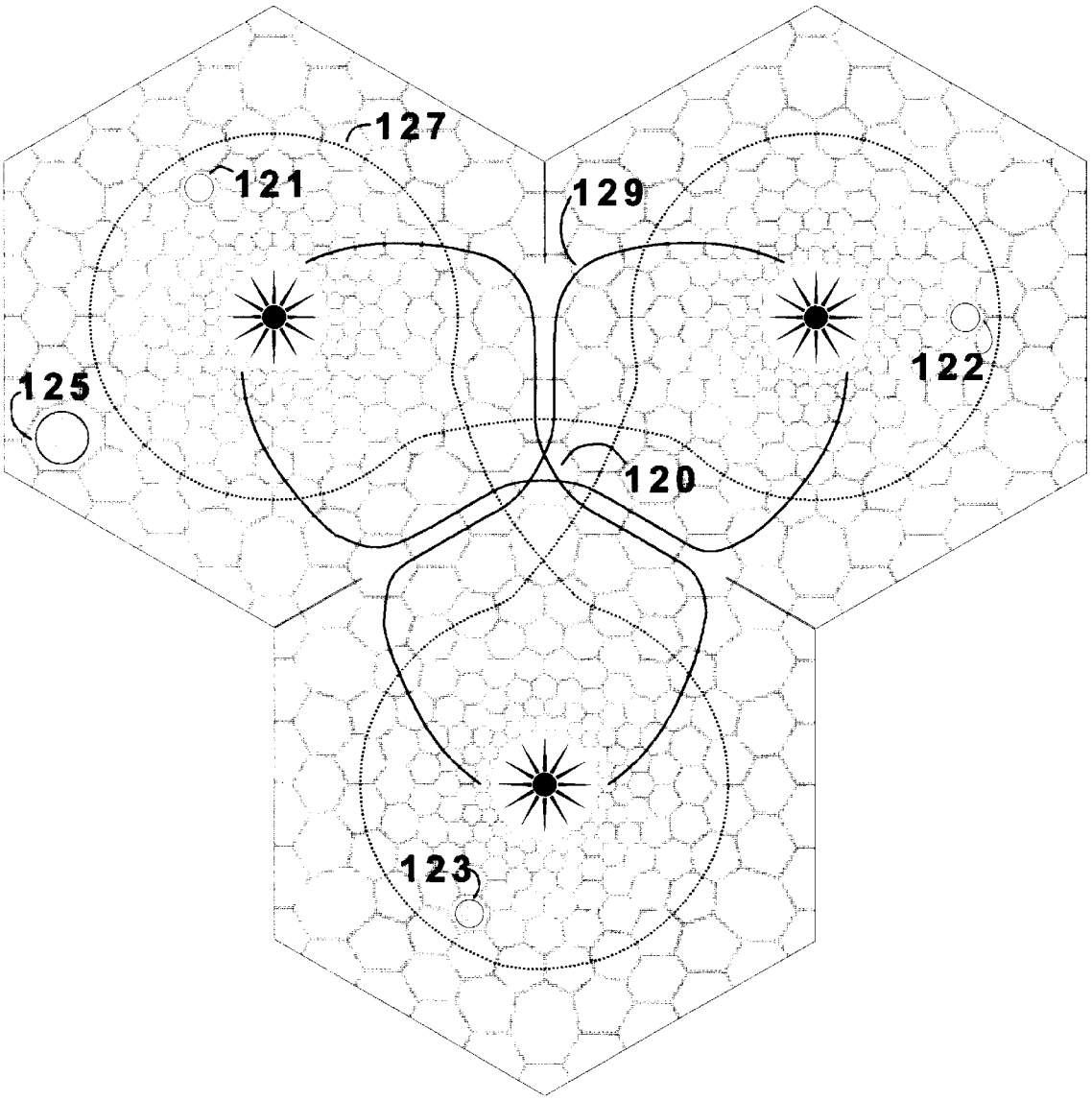
FIG. 24 is a diagram from the game rules illustrating for trinary game board configurations meta-paracircular and meta-parabolic orbits.
Figure 25:
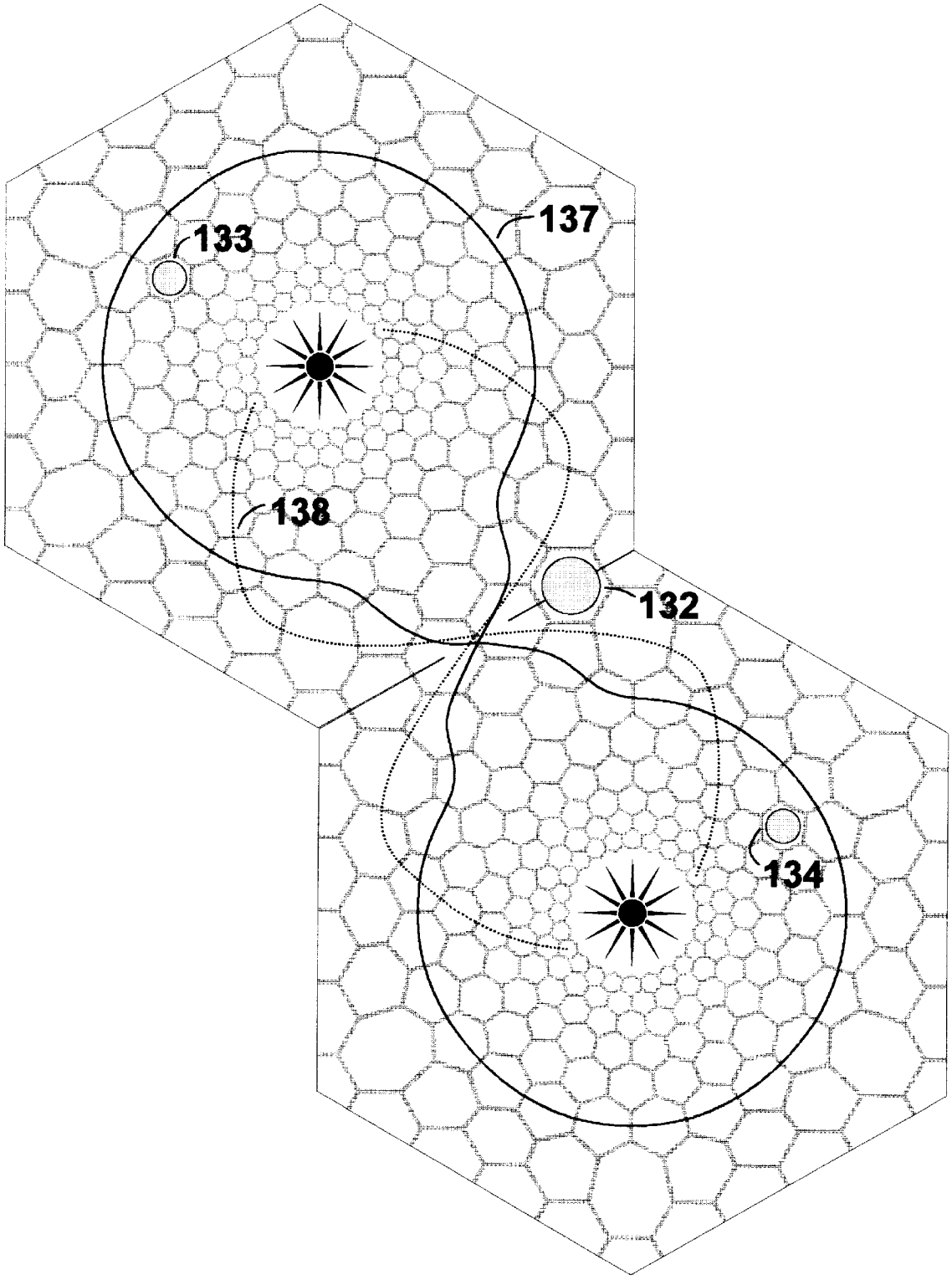
FIG. 25 is a diagram from the game rules illustrating for binary game board configurations two varieties of meta-parabolic orbits.

In multistellar games using three game boards the centrally located interboard hyperspace jump location FIG. 24-#120 is used in conjunction with hyperspace jump markers FIG. 22, distinguished by indicia 110 from other markers, placed upon predetermined intraboard hexagons FIG. 24-#121,#122,#123 such that spacecraft move between any two hyperspace jump locations in one step. In multistellar games using two game boards a hyperspace jump marker FIG. 22 is placed upon any one of the interboard regular hexagons FIG. 25-#132 —which hyperspace jump marker takes the place of the aforementioned centrally located interboard hyperspace jump location used in triple game board configurations— and used in conjunction with hyperspace jump markers placed upon predetermined intraboard hexagons FIG. 25-#133,#134.

Figure 23:
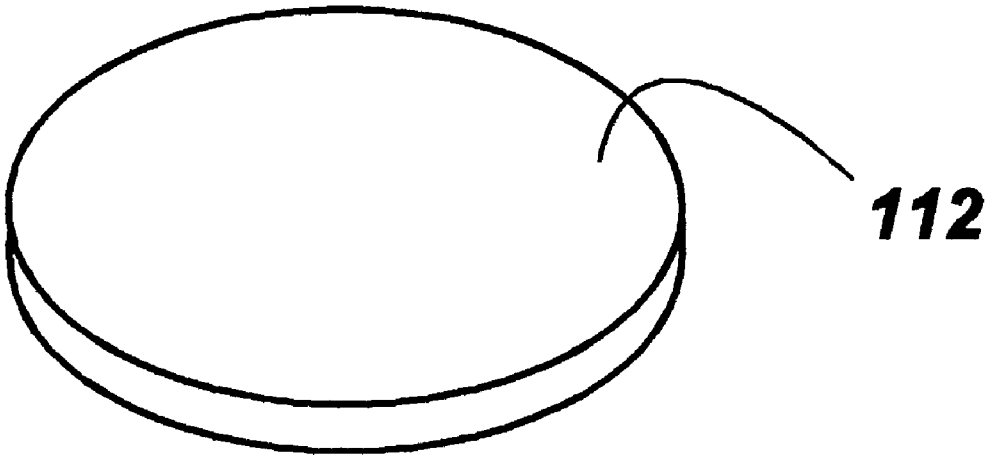
FIG. 23 illustrates a home station marker.

VIII. Home Stations and Home Station Heptagons in Relation to Unistellar and Multistellar Games In any game board configuration the home station heptagons remain fixed, being components of the game board tessellation, and in multistellar games the location of intraboard hyperspace jump markers remain fixed, which creates for multistellar games respective problems of equal player access from home station heptagons to the interboard region and intraboard hyperspace jump markers. The solution is that in multistellar games each player has a home station marker FIG. 23 distinguished by color and indicia 112 that rotates around ring 7 FIG. 24-#125 occupying heptagons in the manner of planets rotating in ring hexagons. A player's spacecraft access their home station, the area in front of their array, from their home station marker wherever it may be in its rotation, entering and exiting the game board from its location.

IX. Grace Markers

Figure 10:
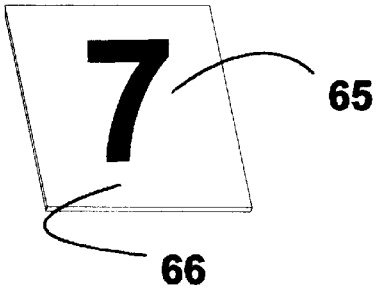
FIG. 10 illustrates a grace marker.

Grace markers FIG. 10 are rectangular shaped, with a numeral 65 to indicate Grace level and adjacent surface 66 with some combination of color and indicia the same for every marker, and scaled to fit on an array ledge. The numeral range is 1 to 12 inclusive. Grace markers are displayed on the right side of the first array ledge 31.

X. Knowledge Markers

Figure 11A:
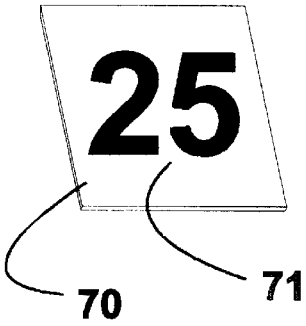
FIGS. 11A, 11B, and 11C illustrate markers for three knowledge categories occurring at three particular levels.
Figure 11B:
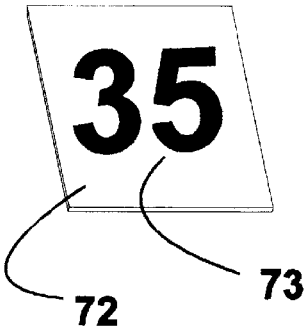
Figure 11C:
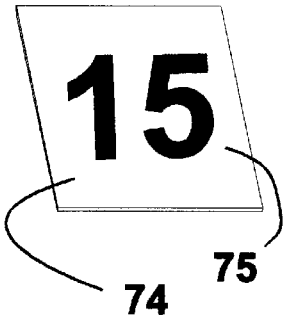

Knowledge markers occur in three categories FIGS. 11A, 11B,11C, each marker being rectangular shaped, with a numeral 71,73,75 to indicate knowledge level, and scaled to fit on an array ledge. The three knowledge category markers are distinguished by some combination of color and indicia on the surface 70,72,74 adjacent to said numeral. The first category incorporates knowledge related to physical science, engineering, mathematics, medicine, biology, and agronomy, and may be abbreviated on catastrophe and entropy cards with "C1", for category one. The second category incorporates knowledge related to social science and management science and may be abbreviated with "C2". The third category incorporates knowledge related to art, literature, music, history, philosophy, and religion, and may be abbreviated with "C3". Knowledge markers are displayed on the right side of the second 32, third 33, and fourth 34 array ledges.

XI. Player Capital

Each player's collection of spacecraft, society markers, resource markers, and knowledge points constitutes their capital, and players are free to exchange that capital according to their interests.

XII. The Composition and Use of Catastrophe and Entropy Cards

Figure 12A:
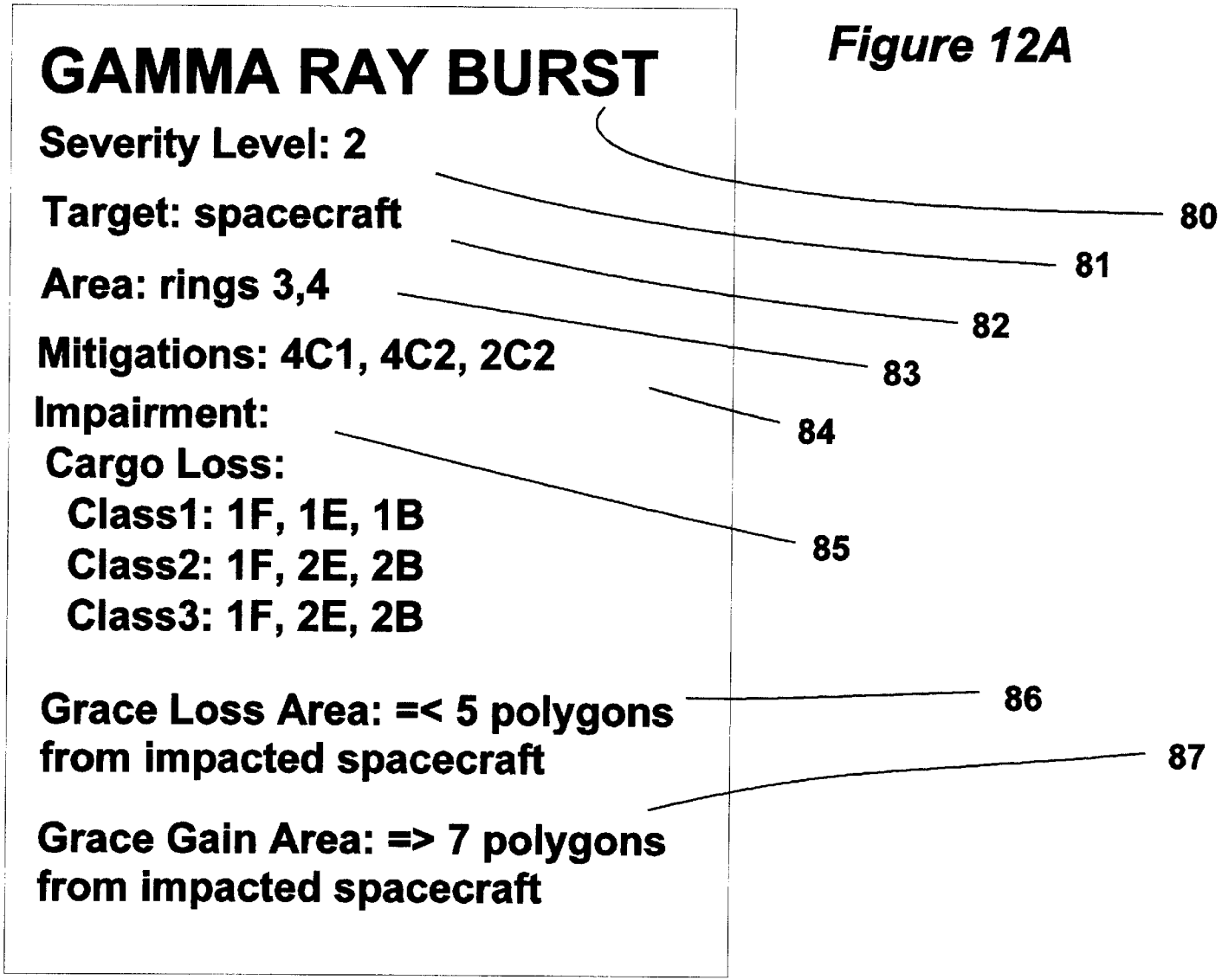
FIG. 12A illustrates a catastrophe card.

The game is played with two card decks; the cards of one deck providing a source of instruction related to catastrophe: natural phenomena uncontingent upon human action and destructive to human purpose; and the cards of the second deck providing a source of instruction related to entropy: the failure of human systems and devices due to causes entirely within such systems and devices and destructive to human purpose. FIG. 12A illustrates one possible catastrophe card, and it provides the player drawing the card information concerning the type of natural catastrophe 80, the catastrophe severity 81, the type of playing piece impaired: spacecraft or society marker 82, a method determining the impact area of that destruction, within which a playing piece is impaired 83, the minimum score for each of said three knowledge categories a player must have for any playing piece in the impact area to avoid being affected 84, the manner of the playing piece's impairment 85, a method determining the area within which the presence of a playing piece of another player necessitates a decision whether to assist the impaired playing piece, wherein a decision to not assist results in Grace level loss and a decision to assist, with diversion of capital, does not change Grace level 86, a method determining the area within which the presence of a playing piece of another player bestows an opportunity to increase the player's Grace level if they chose to assist the aforementioned impaired playing piece, diverting capital to assist, but necessitates no loss of Grace level if that player chooses to not assist 87.

XIII. Example of Catastrophe Card Using Gamma Ray Burst

In FIG. 12A the catastrophe is a gamma ray burst of severity 2 which impairs any one of the card drawing player's spacecraft in rings 3 and 4, the player selecting the particular spacecraft if more than one are in that target area. However, if the player has knowledge category C1 points equal to or greater than 4, plus knowledge category C2 points equal or greater than 4, plus knowledge category C3 points equal to or greater than 2 that player averts the impairment. If not, the spacecraft loses resource cargo according to the spacecraft class; class 1 losing 1 fuel unit, 1 energic resource marker, and 1 ecologic resource marker. Losses to other spacecraft classes are interpreted similarly. Players with spacecraft 5 or less polygons distant —wherein each polygon is one distance unit— from the impaired marker on the turn of the catastrophe card's drawing must divert spacecraft to a polygon adjacent to that of the impaired marker or lose 1 Grace level. Players who assist just assist, without resulting Grace level increase. Players with spacecraft 7 or more polygons distant from the impaired marker receive one Grace point if they chose to assist, but are not penalized a Grace level if they chose to not assist.

XIV. Example of Entropy Card Used With Enumerated Game Board

Figure 12B:
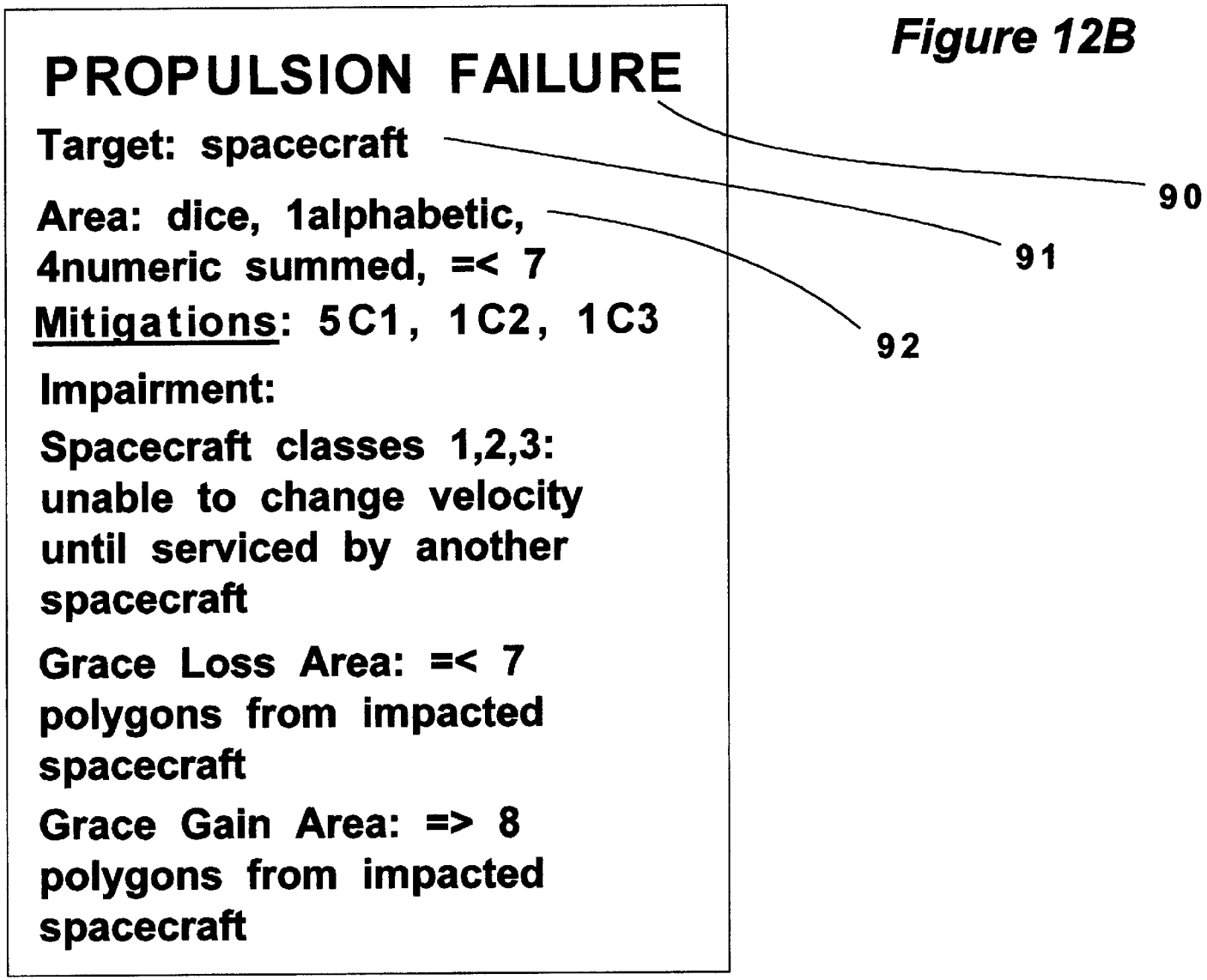
FIGS. 12B and 12C illustrate entropy cards.
Figure 13A:
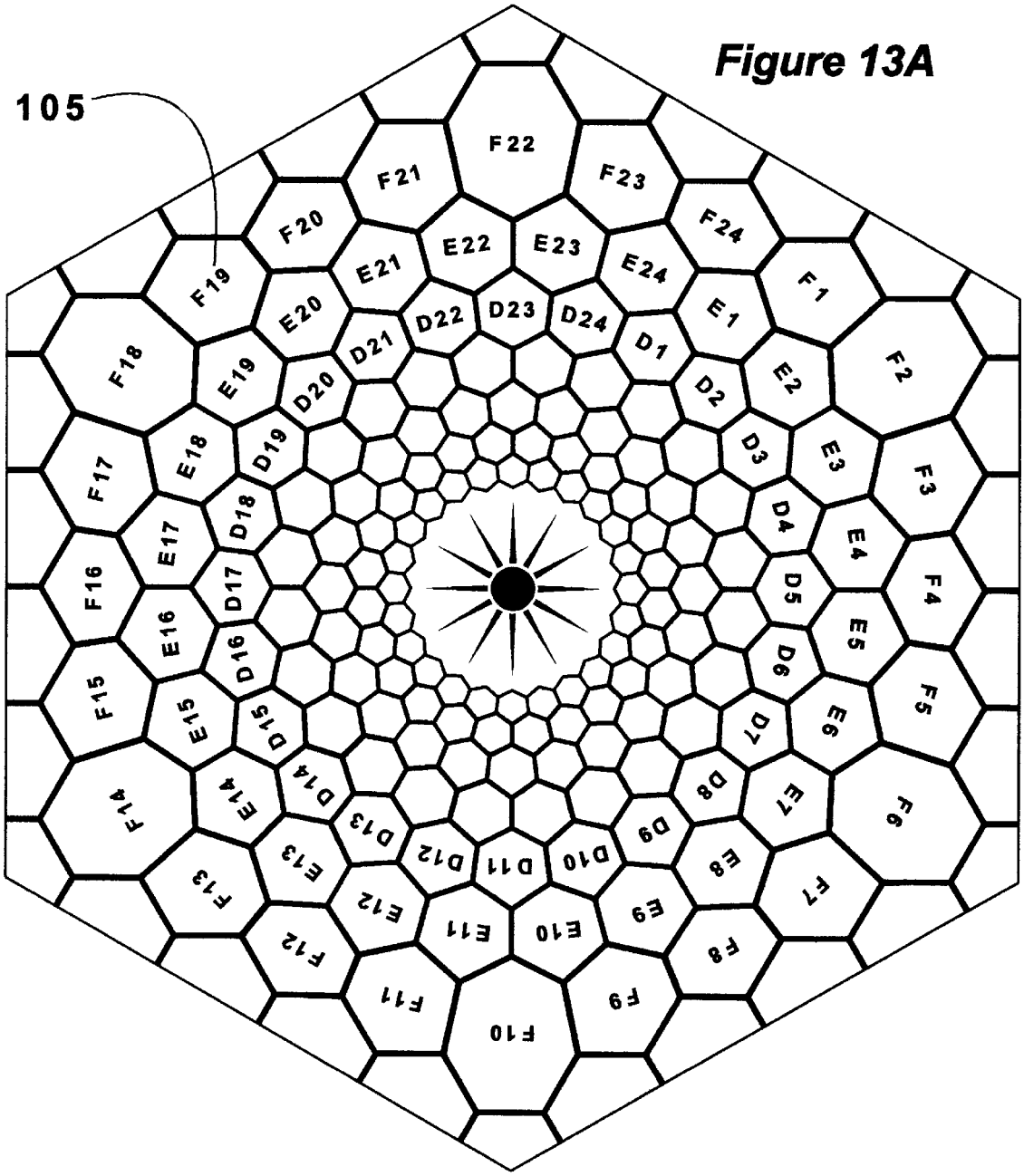
FIG. 13A illustrates a game board with polygons distinguished by indicia.

The entropy card illustrated in FIG. 12B is used in conjunction with a game set using the alternative enumerated game board FIGS. 13A,B. In that game board some polygons contain indicia consisting of a letter and number 105. The letters range from A to F for rings two to seven respectively. Within each ring the polygons are numbered 1 to 24. Using that enumeration system, FIG. 12B describes a spacecraft 91 propulsion entropic failure 90 in which the target area 92 is selected by first throwing one six sided die to select a number, the numbers being agreed upon beforehand to match with letters in manner 1-A, 2-B, 3-C, 4-D, 5-E, 6-F. Thus a throw yielding 5 signifies the letter E. Next four cubic die are thrown and the selected numbers summed. For example, the die faces might sum to the number 19. The letter and number thus obtained are combined to signify polygon E19. Reading the remainder of the field, the target area includes polygons 7 or less polygons distant from polygon E19. Other methods might be use to select a particular polygon for this purpose.

XV. Example of Entropy Card Using Hyperinflation

Figure 12C:
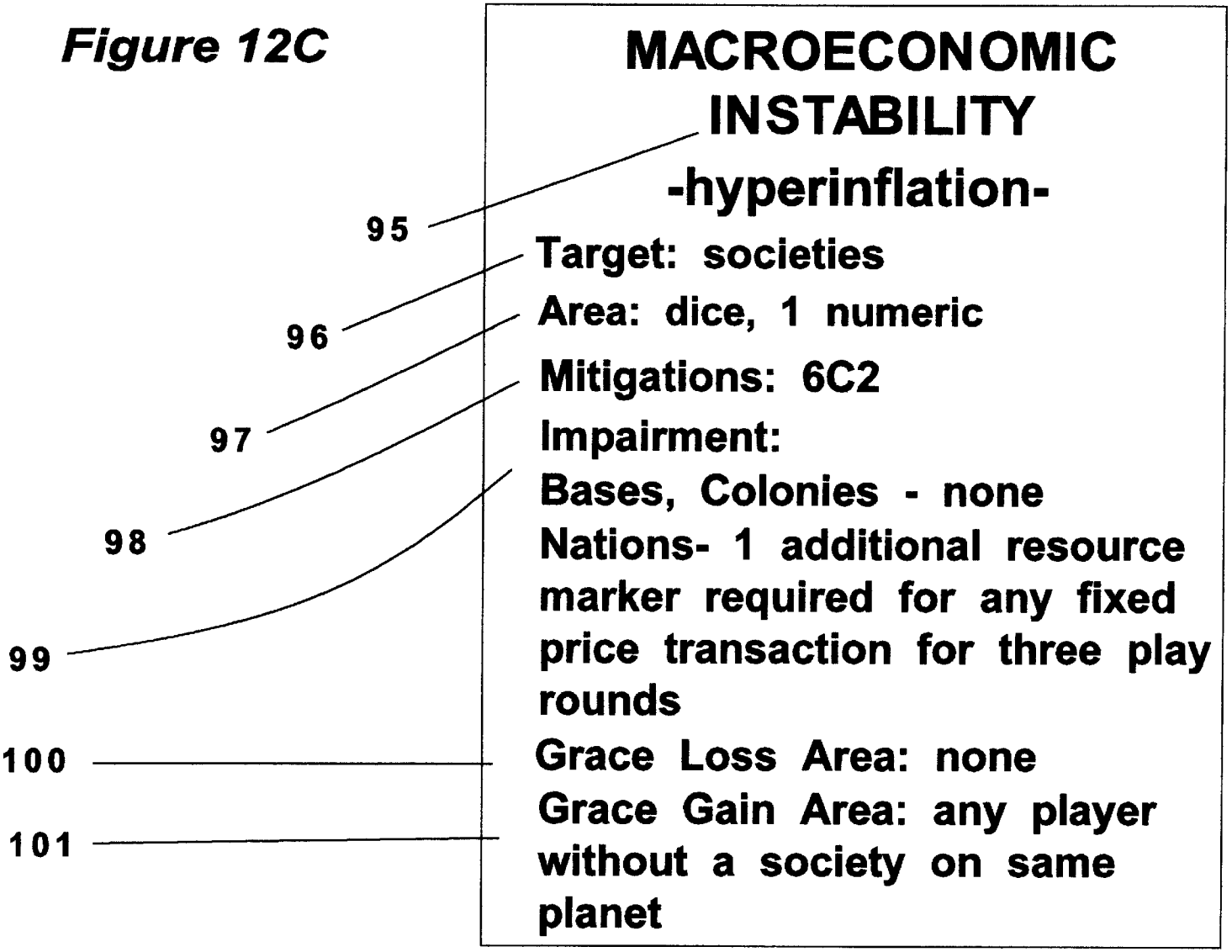

FIG. 12C illustrates another entropy card, designating a hyperinflation entropic failure 95. The target is a collection of player societies 96 on a particular external planet playing piece, which is the target area. That external planet playing piece is selected by the method 97 of throwing one die whose numerals have been agreed upon before hand to match with planets in manner 1,2-M, 3,4-E, and 5,6-B, where M,E, and B signify the mineral, energy, and ecology resource planets, respectively. The societies' impairment 99 is that all player purchases occurring at a fix price, for example one colony for four resource markers, require one extra resource marker. Other player's do not incur Grace lose if they fail to assist the impaired society collection 100. However, any player with no society on that external planet marker can increment their Grace 1 level by assisting the impaired society 101. That assistance's method might be described in a game rules list of general Grace change circumstances as a contribution without remuneration of a sufficient number of knowledge category C2 points so that the impaired society achieves the 6 points needed for impairment mitigation 98.

XVI. Stochastic Modeling of Universal Moral Order

Whether a player is required to draw either a catastrophe card or an entropy card is dependent upon chance. A random function device and the frequency (probability) distribution it generates implements that chance. For example, a computer random number algorithm might generate a flat frequency distribution in which there is a 4% chance

TABLE 1

| Grace Level | | Integer | Probability Greater Than |
|---|---|---|---|
| Catastrophe | Entropy | Selected | or Equal To Integer |
| | 1 | 1 | 100 |
| 1 | 2 | 2 | 96 |
| | 3 | 3 | 92 |
| 2 | | 4 | 88 |
| | | 5 | 84 |
| 3 | 4 | 6 | 80 |
| | | 7 | 76 |
| 4 | | 8 | 72 |
| | 5 | 9 | 68 |
| 5 | | 10 | 64 |
| | | 11 | 60 |
| 6 | 6 | 12 | 56 |
| | | 13 | 52 |
| 7 | | 14 | 48 |
| | 7 | 15 | 44 |
| 8 | | 16 | 40 |
| | | 17 | 36 |
| 9 | 8 | 18 | 32 |
| | | 19 | 28 |
| 10 | | 20 | 24 |
| | 9 | 21 | 20 |
| 11 | | 22 | 16 |
| | | 23 | 12 |
| 12 | 10 | 24 | 8 |
| | 11–12 | 25 | 4 |

of selecting each number from 1 to 25 inclusive. The cumulative distribution identifying for reach integer —column 3— the probability—column 4— that an integer equal to or greater than that integer will be selected by the random function is demonstrated in Table 1. For each player Grace level, 1–12 inclusive, in column 1 there is a corresponding integer in its row in column 3. If the random function device selects an integer equal to or greater than that integer the player must draw from the catastrophe deck. Thus, there is a mathematical mapping between the integers of column 1 and those of

TABLE 2

| Grace Level | | Integer | Probability Greater Than |
|---|---|---|---|
| Catastrophe | Entropy | Selected | or Equal To Integer |
| | | 1 | 100 |
| | 1–2 | 2 | 96 |
| | | 3 | 92 |
| 1 | | 4 | 88 |
| | 3 | 5 | 84 |
| 2 | | 6 | 80 |
| | | 7 | 76 |
| 3 | 4 | 8 | 72 |
| | | 9 | 68 |
| 4 | | 10 | 64 |
| | 5 | 11 | 60 |
| 5 | | 12 | 56 |
| | | 13 | 52 |
| | 6 | 14 | 48 |
| | | 15 | 44 |
| 7 | | 16 | 40 |
| | 7 | 17 | 36 |
| 8 | | 18 | 32 |
| | | 19 | 28 |
| 9 | 8 | 20 | 24 |
| | | 21 | 20 |
| 10 | | 22 | 16 |
| | 9 | 23 | 12 |
| 11 | | 24 | 8 |
| 12 | 10–12 | 25 | 4 |

column 3, and this is designated a "type one mapping" in the patent claims section. Similarly, for each player Grace level in column 2 there is a corresponding integer in its row in column 3. If the random function device selects an integer equal to or greater than that integer the player must draw from the entropy deck. The mathematical mapping between the integers of column 2 and those of column 3 is designated a "type two mapping" in the claims. The

TABLE 3

| Grace Level | | Integer | Probability Greater Than |
|---|---|---|---|
| Catastrophe | Entropy | Selected | or Equal To Integer |
| 1 | 1–2 | 1 | 100 |
| 2 | 3 | 2 | 96 |
| | | 3 | 92 |
| 3 | | 4 | 88 |
| | 4 | 5 | 84 |
| 4 | | 6 | 80 |
| | | 7 | 76 |
| 5 | 5 | 8 | 72 |
| | | 9 | 68 |
| 6 | | 10 | 64 |
| | 6 | 11 | 60 |
| 7 | | 12 | 56 |
| | | 13 | 52 |
| 8 | 7 | 14 | 48 |
| | | 15 | 44 |
| 9 | | 16 | 40 |
| | 8 | 17 | 36 |
| 10 | | 18 | 32 |
| | | 19 | 28 |
| 11 | 9 | 20 | 24 |
| | | 21 | 20 |
| 12 | | 22 | 16 |
| | 10 | 23 | 12 |
| | 11 | 24 | 8 |
| | 12 | 25 | 4 |

difference between the type one mapping and the type two mapping is that for the former changes of one Grace level result in less change in the cumulative probability in column 4 than for the latter. This simulates a universal moral order in which moral transformation, toward either the good or wicked polarities, has greater corresponding ramification in the realm of human act and artifice than in the natural realm, existing apart from human influence; which is notorious for visiting disaster upon the benignant and innocent as well as the malefic and morally compromised.

XVII. Variation of Universal Moral Order Clemency-Punativeness

Table 2 illustrates, for the same cumulative distribution used in Table 1, type one and two mappings in which Grace levels have been shifted toward higher cumulative probabilities, whereby is simulated a universal moral order more punitive than that signified in Table 1. Alternatively, Table 3 illustrates for Table 1's cumulative distribution, type one and two mappings in which Grace levels have been shifted toward lower cumulative probabilities, whereby is simulated a universal moral order more forgiving than that signified in Table 1. Thus, Table 1 signifies a moral order intermediate between Table 2 and Table 3 in its clement-punative degree. Before commencing a game, players chose which moral order clement-punative degree to structure their interaction.

For subsequent discussion of the preferred game embodiment, the random function device will be four tossed cubic die whose faces are summed to obtain an integer occurring in a cumulative distribution analogous but not equivalent to that in the Tables.

XVIII. Society Markers

Society markers may be manufactured from sheet material in shapes selected from a group that includes FIGS.

Figure 14A:
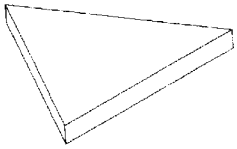
FIGS. 14A, 14B, 14C, 14D, 14E, and 14F illustrate a group of flat shapes suitable for society markers representing a progression of increasingly complex societies.
Figure 14B:
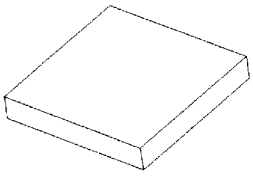
Figure 14C:
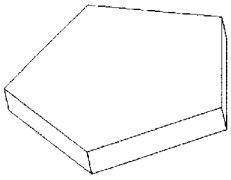
Figure 14D:
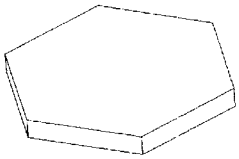
Figure 14E:
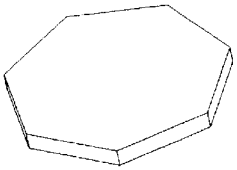
Figure 14F:
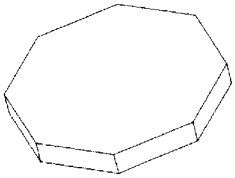
Figure 15:
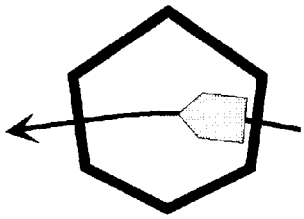
FIG. 15 is a diagram from the game rules instructing the positioning of spacecraft markers upon polygons.
Figure 16A:
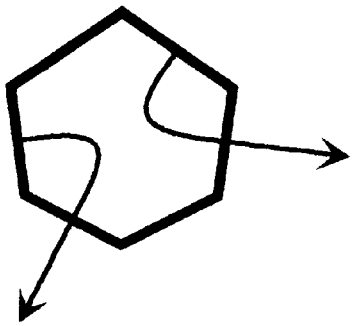
FIGS. 16A and 16B are diagrams from the game rules instructing forbidden polygon crossings.
Figure 16B:
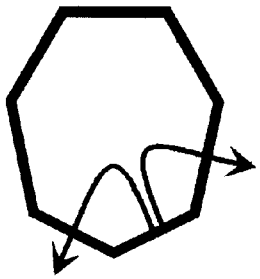

14A,14B,14C,14D,14E,14F. Society markers would be ordered one in relation to the others such that the greater a society's complexity, the greater the number of its marker's sides. For this preferred game embodiment, FIG. 14A is a marker for a base, FIG. 14B is a marker for a colony, and FIG. 14C is a marker for a nation.

XIX. The Navigation Component Governing Spacecraft Motion

The game rules specify the interaction of a spacecraft's fuel and speed parameters for every possible polygon and planet traverse. The game board's tessellation is complex and every such contingency need not be explained, but the essential contingencies involve (a) a correspondence between a spacecraft's speed marker numeral and the number of polygons that spacecraft traverses each player turn, (b) the necessity that a spacecraft always sustains a position with respect to the polygons it traverses or comes to rest upon FIG. 15, (c) traversal of the central star figure, illustrated in FIGS. 18A,B,C in which the star's rays and spaces between rays and ring one polygons are used to delineate specific parabolic orbits, (d) differentiation of circular, parabolic, and paracircular orbits and the fuel decrement required to exit each, illustrated in FIGS. 19A,B, (e) velocity (speed and direction) changes resulting from planetary traversal, illustrated in FIGS. 17,21A,B,C, (f) permitted traversals of hexagonal and heptagonal polygons, illustrated in FIGS. 16A,B, and (g) speed and fuel implications for velocity changes in the interstellar region, illustrated in FIGS. 20A,B. FIGS. 15–21 are selected from the set of game rules diagrams.

XX. The Distinction Between Players and Teams

Throughout the rules for the unistellar game board configuration it is written that a "player" commands a home station and its nine spacecraft. However, to accelerate and simplify the game it is advantageous to distribute control of groups of a player's spacecraft to individuals. Thus, for example, if six of a player's spacecraft are active on a game board, three individuals could control three groups of two spacecraft. When groups of individuals control spacecraft in this way, the "player" becomes a "team" in game rule parlance. "Team" is used exclusively in the multistellar game board rules, because the inherent complexity of simultaneous play in multiple arenas make team control over spacecraft a beneficial simplification of play. Multistellar games begin with each game board hosting two or more home stations. Each team begins the game competing primarily with teams sharing its home board (although not necessarily, if an advantage to visit another game board exists). Once a team establishes strong and stable positions regarding capital, knowledge, and Grace on its home board it is free to compete on non-home boards until there is established a multiple game board team that is exemplary with regard to knowledge and Grace. Thus, beginning with multiple teams on multiple game boards, competition advances across all game boards until there emerges one exemplary team.

XXI. Synchronization of Team Turns in Multistellar Games

The multistellar game requires rules governing the synchronization of team turns that are, first, sequential in the context of one area —intraboard region or interboard region— and, second, simultaneous in the context of multiple areas, with rounds of play in different areas advancing independently according to different tempos (number of rounds of play per time interval). In some games these synchronizations of turns may become sufficiently complex to require pencil and paper to track. An alternative to that synchronization complexity is gained by synchronizing rounds of play on all game boards such that they begin and end with the simultaneous advancement of the planets on all game boards. However, the trade-off of that synchronization's simplicity is that to insure uniform play pace across all game boards such that teams on some game boards do not have to wait for teams on other game boards to complete their play round before the former teams commence a new round of play (after planet advancements on all game boards), it may be necessary to limit the duration of team turns using a stop watch or (1, 2, or 3 minute duration) "hour glass", allotting, for example, two minutes for each team to complete their turn.

XXII. Meta-paracircular and Meta-parabolic Orbits in Multistellar Games

An additional benefit resulting from synchronizing the advancements of all planets on all game boards is that it enables the plotting of complex, stable spacecraft orbits involving planet traverses on multiple game boards. There may also be plotted simpler orbits spanning multiple game boards, simulating the influences of the stellar gravities alone. FIG. 24 depicts for the trinary game board configuration what is termed a meta-paracircular orbit 127 and what is termed a meta-parabolic orbit 129. Two varieties of analogous metaparabolic orbits FIG. 25-#137,#138 exist for the binary game board configuration.

XXIII. The Criteria for Winning in Starworlds Synergy

The game, named "Starworlds Synergy", progresses according to a complex dynamic. A game winner is determined by first summing each player's three knowledge category levels to obtain a collective knowledge level for each player, and then multiplying each player's collective knowledge level times their Grace level to obtain their duplex score; the player with the highest duplex score being the game winner. In games using multiple game boards in a multistellar game board configuration teams on all game boards may compete individually against each other or each game board's collection of teams with home stations thereon may be deemed groups working in cooperation and their group scores being the duplex score derived by multiplying the average of group member's collective knowledge levels times the average of their Grace levels. In either unistellar or multistellar games a criterion must be selected for cessation of play and comparison of competitor (player, team, or group) scores, since the absence of competitor incentive to eliminate each other's playing pieces may cause protracted games. One criteria is to use an outer planet, which revolves slowest of the planet types, like the hand of a clock and cease play when the planet achieves a predetermined position. Another criteria is to cease play when one competitor (player, team, or group) achieves a pre-stated number of societies, such as, for example, nations on all three (nonfuel) resource planets.

XXIV. Duplex Score Maximization

Maximization of the duplex score, therefore, requires maximization of both the knowledge and Grace levels, which is a player's or team's primary objective. Society markers established on external planet markers —which are motionless surrogates of planets revolving on the game board— cause to be distributed to players the three knowledge category points. Society markers occur in three degrees of complexity, —bases, colonies, and nations— and each generates a different mix of the three knowledge category points. A player's collective knowledge level is the sum of their three knowledge category levels, which set of three numbers is termed the player's knowledge triple. Society markers generate those three categories of knowledge points at regular intervals determined by the position of planets in their orbits. Since each individual society marker established for a player generates knowledge points, a subsuming player strategy is to maximize the number of their society markers. Society markers are purchased, either directly or indirectly, with planetary resource markers. The fundamental unit of society marker is the base, which requires for establishment upon an external planet marker one resource marker from each of the other two planet types, which resource markers are physically transported by spacecraft using the above described array mechanism. Two base markers may be exchanged for one colony marker, and two colony markers may be exchanged for one nation marker. Once a society marker is established upon its external planet marker, it causes to be distributed to its player from a central store resource markers of the type associated with its planet, thus multiplying that resource marker type for its player and augmenting the player's inventory used to establish further society markers, using their spacecraft to transport them to their chosen external planet markers. Before a player establishes their first base, however, the player obtains their initial resource markers from planets by traversing those planets, signifying rudimentary resource collection expeditions. The spacecraft themselves are available to players in three classes with varying cargo capacity and capacity to deflect catastrophe and entropy events and capacity to extend that protection to nearby spacecraft and societies. The spacecraft are purchased at a rate of two resource markers for one primary class spacecraft, four resource markers for one secondary class spacecraft, and six resource markers for one tertiary class spacecraft, the most powerful. Thus the capital value of spacecraft is their purchase rate and a player may exchange their own spacecraft at that rate, for example exchanging two primary class spacecraft for one secondary class spacecraft. Such exchanges occur at a player's home station, the area in front of their array where they deposit resource markers and spacecraft until their use, which home station is accessed when a player's spacecraft lands upon the seventh ring heptagon the player has selected for that purpose at a game's beginning, designating it the player's home station heptagon.

XXV. Spacecraft Navigation Skill Required to Develop Societies

Since the establishment of society markers and the purchase of differentially powerful spacecraft depend upon a player's use of spacecraft to transport, using the array mechanism, resource markers between varying embarkations and destinations of planets, external planet markers, and home station, skillful navigation through the stellar planetary field, represented by game board paths, is crucial. Each spacecraft carries a fuel supply, which can be incremented by traversal of an outer planet, simulating an orbit used to gather energetic subatomic particles trapped in the planet's magnetic field. That fuel can henceforth be exchanged for some combination of spacecraft speed change and direction change, in which maneuvers the speed marker's numeral is changed and/or the spacecraft's direction is changed coordinate with decrements of the fuel marker numeral. The skillful player utilizes circular, parabolic, and paracircular orbits, which a spacecraft can maintain indefinitely without changes to its speed or fuel. Exit from such stable orbits, however, usually requires fuel decrement. All planets can be used to change spacecraft direction without fuel use and with resulting speed increase. The star figure's twelve rays and the twelve spaces between rays are used to guide spacecraft traces of parabolic orbits near the star figure. In multiple game board configurations, hyperspace jump locations are designated which enable spacecraft to jump between distant game board areas without having to traverse intermediate polygonal paths.

XXVI. Determinants of Grace Level

As completely as is practically feasible, all player decision's with direct ramification for other players are subsumed in their consequence for the deciding players by a moral dynamic. Sometimes that consequence, in terms of Grace level change, is dictated by a general list covering circumstances such as player bartering and deal making, but most often the player decision is forced by the mechanism of the above described catastrophe and entropy cards. At the beginning of each turn a player selects an integer using a random function device, which in this game embodiment is the sum of the faces of four tossed cubic die, and then using a table such as described above compares that integer to an integer dictated by the player's Grace level to determine whether the randomly selected integer is equal to or greater than the player's Grace level dictated integer. If that is the case the player must draw a catastrophe card. Then the player repeats the random function procedure to obtain a second integer, which the player compares to another integer, in a second table column, also dictated by the player's Grace level to determine whether to draw an entropy card. The player drawing a card of either type risks the loss or restriction of a society marker or spacecraft, and other player's may or may not, according to conditions dictated upon the card, be forced to decide between sacrificing Grace level, incurring Grace level decrement, for the immediate goals of a playing piece or sacrificing the immediate goals of a playing piece for Grace level increment. Since the crucial integers dictating whether a player risks loss subsequent a catastrophe or entropy card draw are dependent upon a player's Grace level, that Grace level partially determines the frequency that a player risks loss (the other determining part being random selection structured by a frequency distribution). Thereby is simulated a universal moral order subsuming player decisions regarding other players. As explained above, that moral order can be adjusted in its clement-punative degree, the frequency at which player's risk loss, by the players' selection at a game's beginning of a mapping shifted toward higher or lower cumulative probabilities.

XXVII. Synopsis of Starworlds Synergy Play

Thus, in this exchange and maneuver of markers is simulated parties in a distant human future, economically engaged in single or multiple star systems, owning fleets of spacecraft which are used to initially extract and transport planetary resources to establish societies of varying complexity in order that those societies can contribute to those players' wealth by (a) further development of planetary resources, distributed by spacecraft, to further establish societies and procure additional spacecraft of varying capability and (b) development of players' knowledge stores. Spacecraft navigation is fundamental to those parties' prospect of wealth accumulation because they are the sole means of resource distribution, and skillful navigators master orbits which harvest fuel from planets distant from their star and adjust orbit and speed while conserving fuel by encounters with planets. Spacecraft and societies both are threatened by an abundance of catastrophic natural phenomena and entropic failure of human created systems and devices, and the knowledge produced by societies enable those parties to avoid or recover from such hazard which occur randomly in part as a function of each party's accumulated morality achieved through their history of neglect or response to the tribulations of other parties. It is knowledge multiplied by Grace that establishes the supreme competitor.

XXVIII. Initial Playing Pieces Distributions and Configurations

Figure 6A:
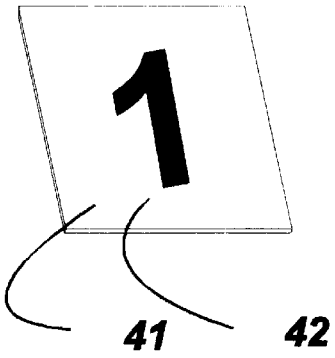
FIG. 6A illustrates a spacecraft identity marker of particular class and number.
Figure 6B:
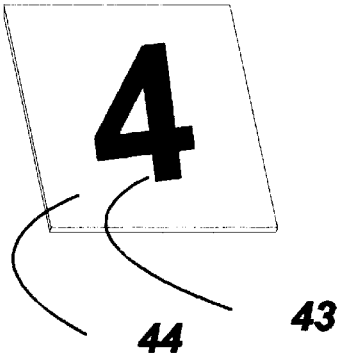
FIG. 6B illustrates a speed marker of particular magnitude.
Figure 6C:
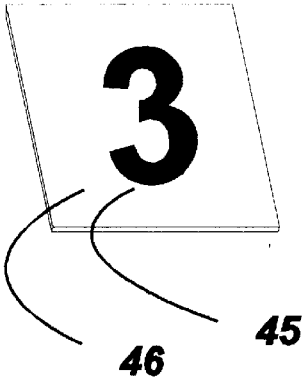
FIG. 6C illustrates a fuel marker of particular magnitude.

A "Starworlds Synergy" game begins with the distribution to players of their arrays FIG. 5A, three spacecraft FIG. 4—two of the primary class and one of the secondary class—spacecraft identity markers FIG. 6A for the three spacecraft, and for each spacecraft identity marker, speed markers FIG. 6B of unit two and fuel markers FIG. 6C of unit two, and level 7 Grace markers FIG. 10 (intermediate in the range 1 to 12). Players' chose the heptagon FIG. 2A-#5 upon which they will introduce and exit spacecraft; that heptagon being the extension onto the game board of their home station area in front of their array, where they will deposit spacecraft and resource markers until their use. The planets FIGS. 7A,7B, 7C are positioned initially in each's ring by tossing four cubic die to obtain an integer 4–24 inclusive. For games using the unenumerated game board FIG. 1 players must select an arbitrary polygon 1 position in each ring from which to begin counting the number of polygons indicated by the die sum for the initial planet position. For games using the enumerated game board FIG. 13A,B the polygon numbers 1–24 are specified. The two outer planets are positioned directly opposite one another in ring 7 FIG. 2A-#4, the two middle planets are placed directly opposite one another in ring 5 FIG. 2A-#9, and the single inner planet is positioned in ring three FIG. 2B-#10. Henceforth, the outer planet will be source of spacecraft fuel, the middle planets will be source of ecologic and energic resource markers respectively, and the inner planet will be source of mineral resource markers.

XXIX. Initial Parameterizations in Multistellar Games

In the unistellar game configuration, the aforesaid actions are taken by the players using one game board, and in multistellar games using two or three conjoined game boards players on each game board take these actions. In addition, for multistellar games players must decide whether to absolutely synchronize player turns on all game boards by advancing the planets on all game boards simultaneously. Such an absolute synchronization may require individual player turns be limited in duration by a timing device such as a stop watch.

XXX. Spacecraft Used To Obtain and Transfer Resource Markers

Players in their turn then embark their spacecraft from their home station heptagons, each traversing a number of polygons equal to the numeral on each's speed marker; each player advancing on every turn all of their spacecraft in play on the game board. Each player's goal is to use their spacecraft to transport resource markers FIGS. 8A,8B,8C of two distinct types to a planet of the third resource type, whereby a base marker FIG. 14A may be placed upon the latter type planet's external planet marker. Spacecraft obtain a resource marker from a planet simply by traversing the planet (FIGS. 17,21A,B,C for example of planetary traversal). That accomplished, the resource marker is positioned on the traversing spacecraft's fourth array ledge FIG. 5A-#31D in its spacecraft identity marker column. When that resource marker carrying spacecraft traverses the planet chosen by its player for a society marker, the resource marker is transferred from the array to the player's arbitrarily agreed upon quadrant upon the associated external planet marker FIG. 9. When the player has collected two such resource markers of type different from one another and different from the external planet marker's resource type, the player may exchange those two resource markers for a base marker FIG. 14A, the resource markers then being returned to a central store of playing pieces. Subsequently, on any external planet marker, two base markers may be exchanged for one colony marker FIG. 14B and two colony markers exchanged for one nation marker FIG. 14C; the base markers and colony markers being returned to a playing piece store after their exchange. Alternatively, a colony marker may be exchanged for four resource markers of stated variety or a nation marker exchanged for eight resource markers of stated variety.

The rapidity with which players establish society markers upon external planet markers is governed by their navigational skill, harvesting fuel by traversing outer planets using that fuel to increase or decrease speed or adjust orbit between the circular, parabolic, and paracircular types upon which a spacecraft may advance indefinitely without change of speed or fuel.

XXXI. The Array's Modeling of Spacecraft Parameters

Figure 17:
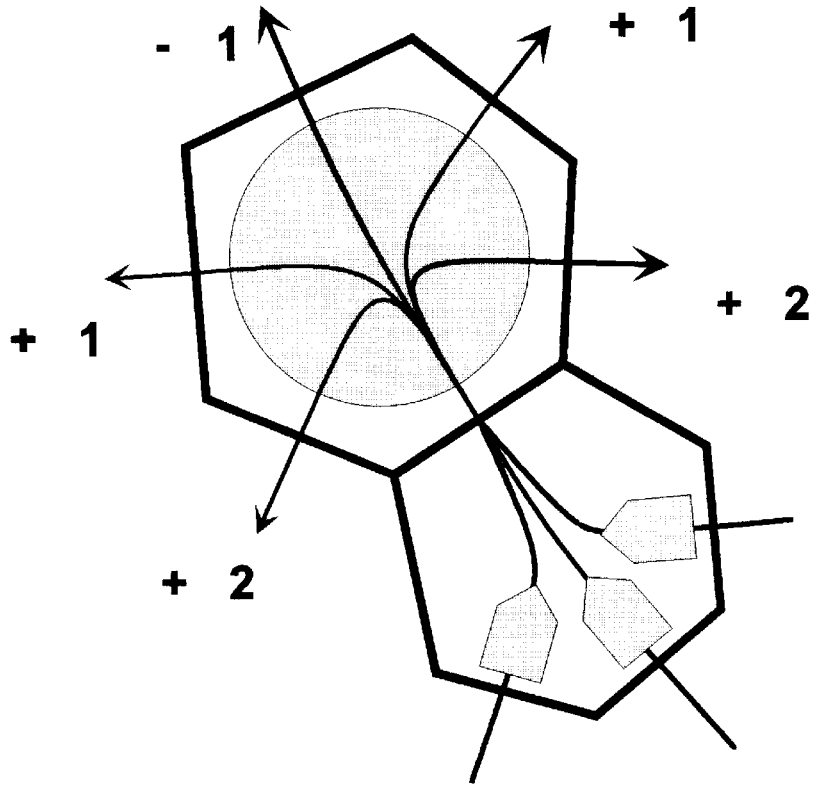
FIG. 17 is a diagram from the game rules instructing spacecraft marker velocity changes resulting from planetary traversal using positions beginning and ending within an interior game board (intraboard) region.
Figure 18A:
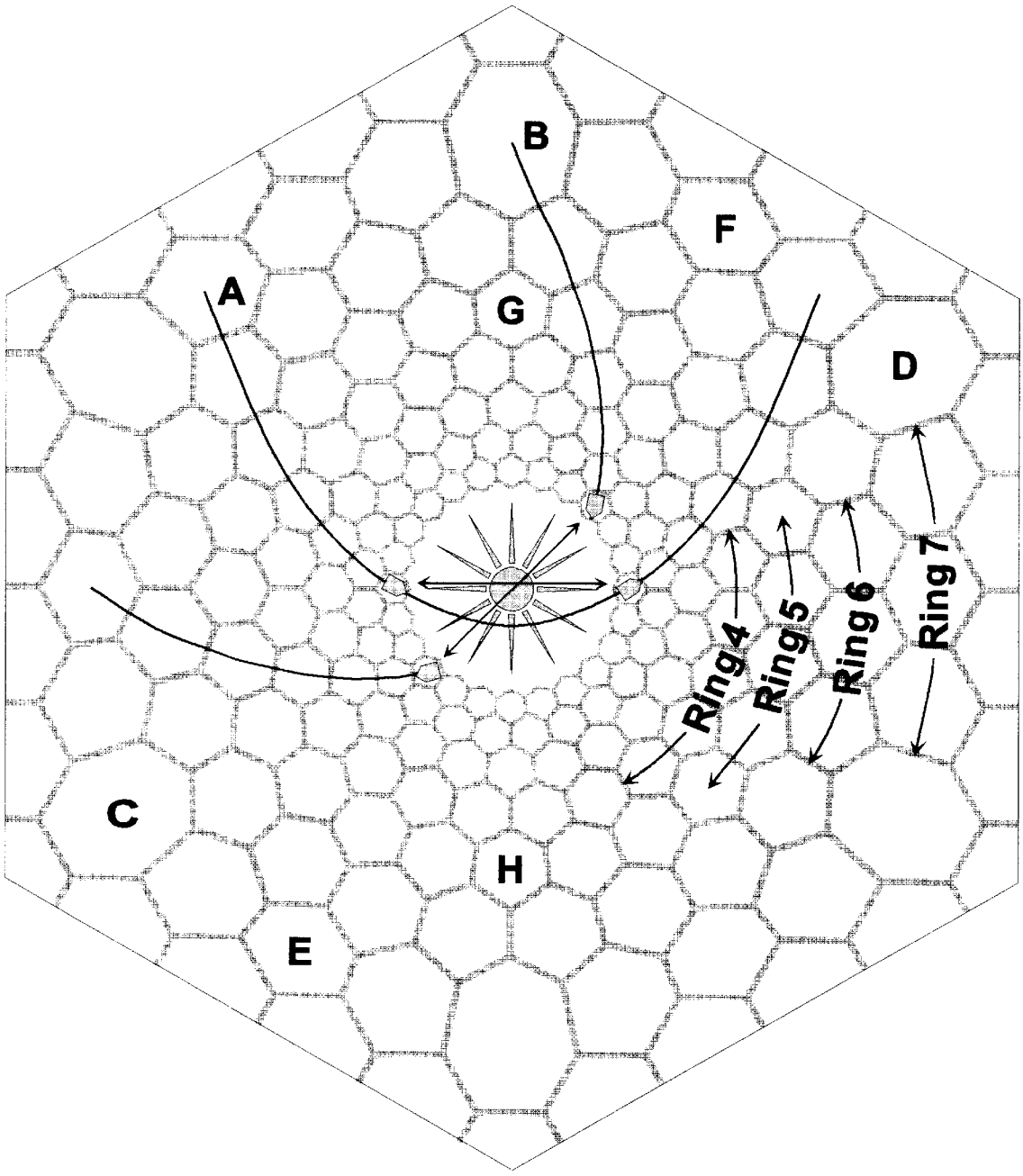
FIG. 18A is a diagram from the game rules that illustrates the oppositely positioned polygons upon which planet markers commence their rotations.
Figure 18B:
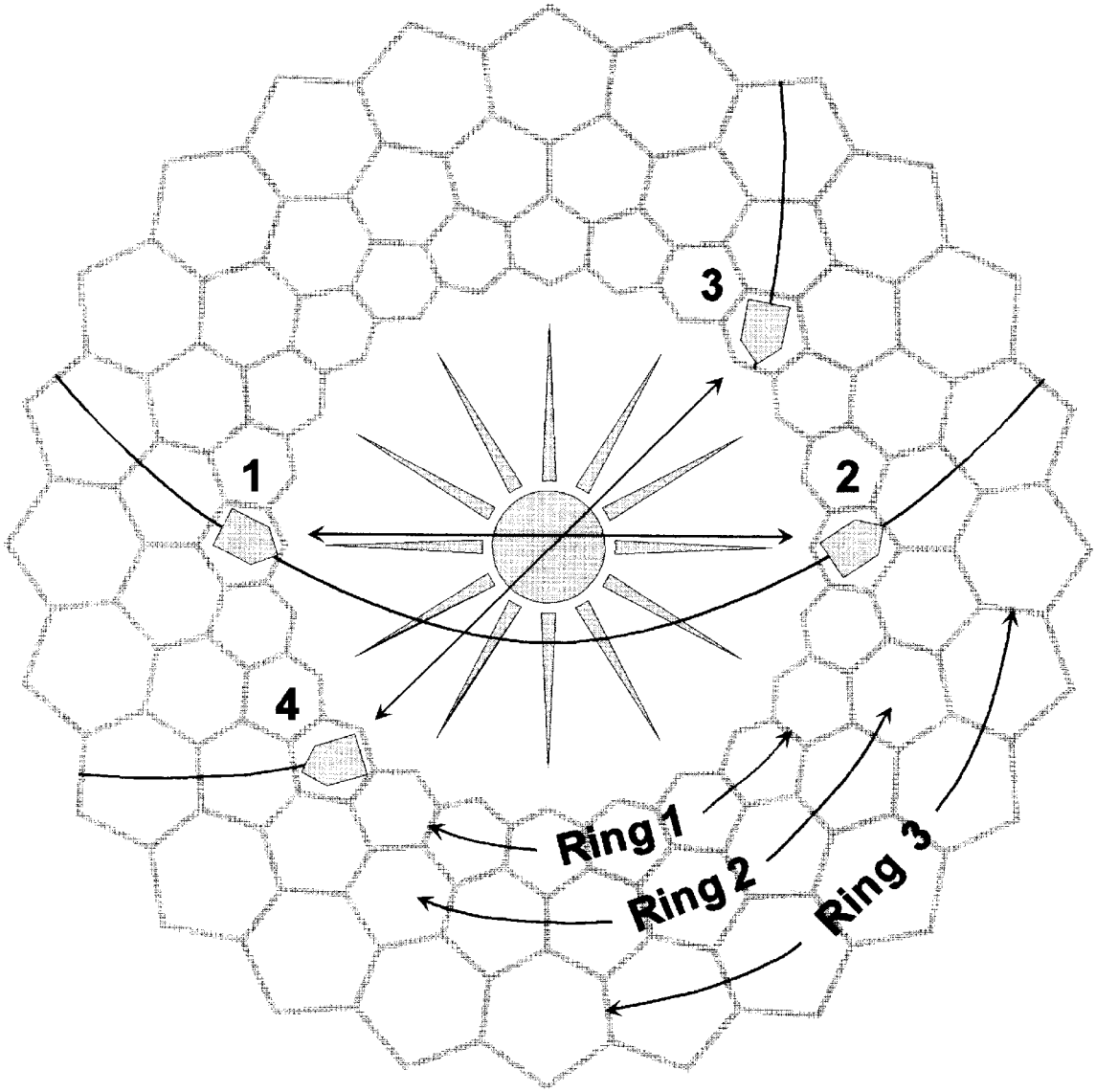
FIG. 18B is a sectional view of FIG. 18A instructing spacecraft marker traversal of the game board's central star figure.
Figure 19A:
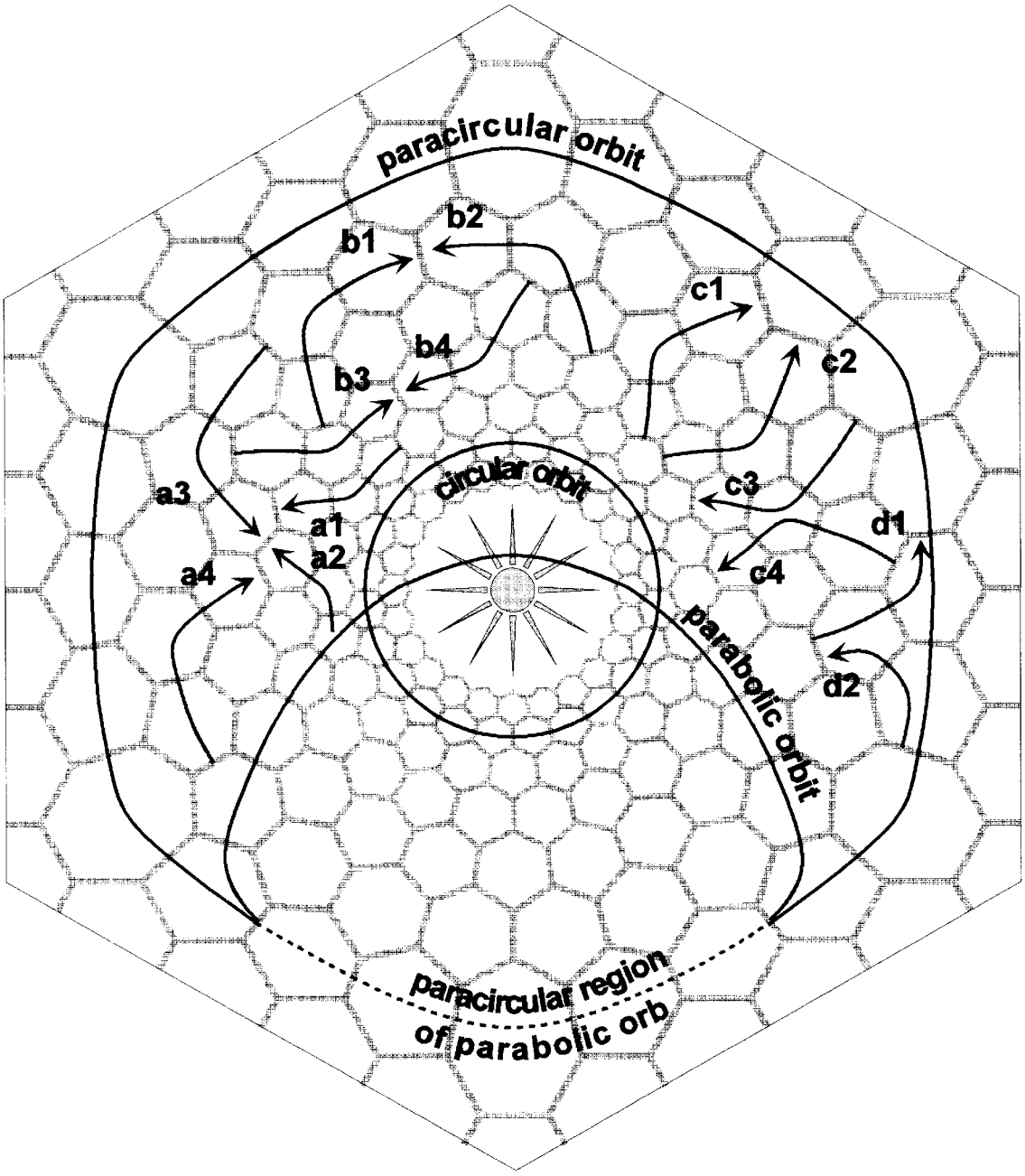
FIG. 19A is a diagram from the game rules instructing the differentiation of circular, parabolic, and paracircular orbits.
Figure 20A:
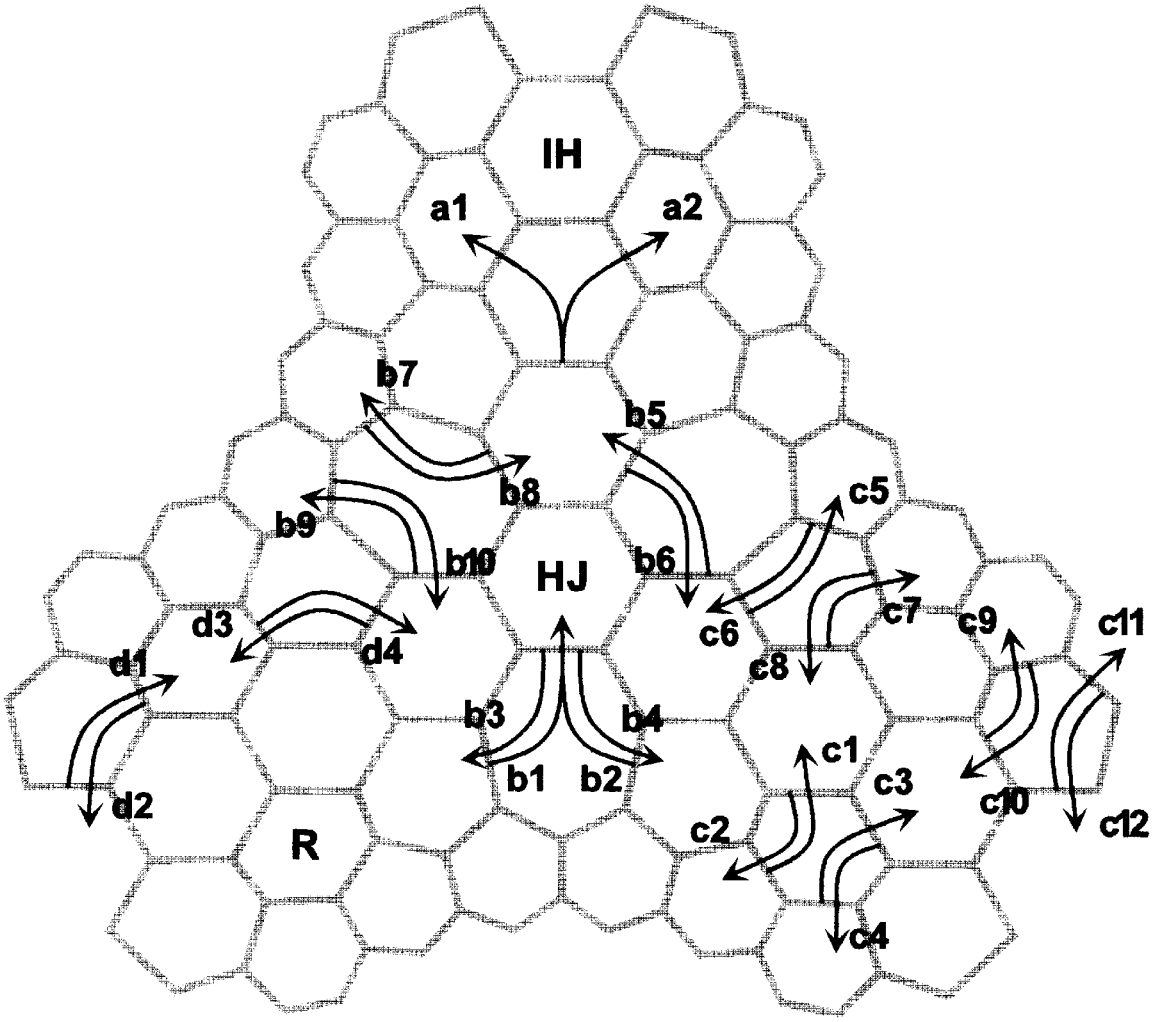
FIG. 20A is a diagram from the game rules instructing speed and fuel ramifications for direction changes in the interstellar region.
Figure 21A:
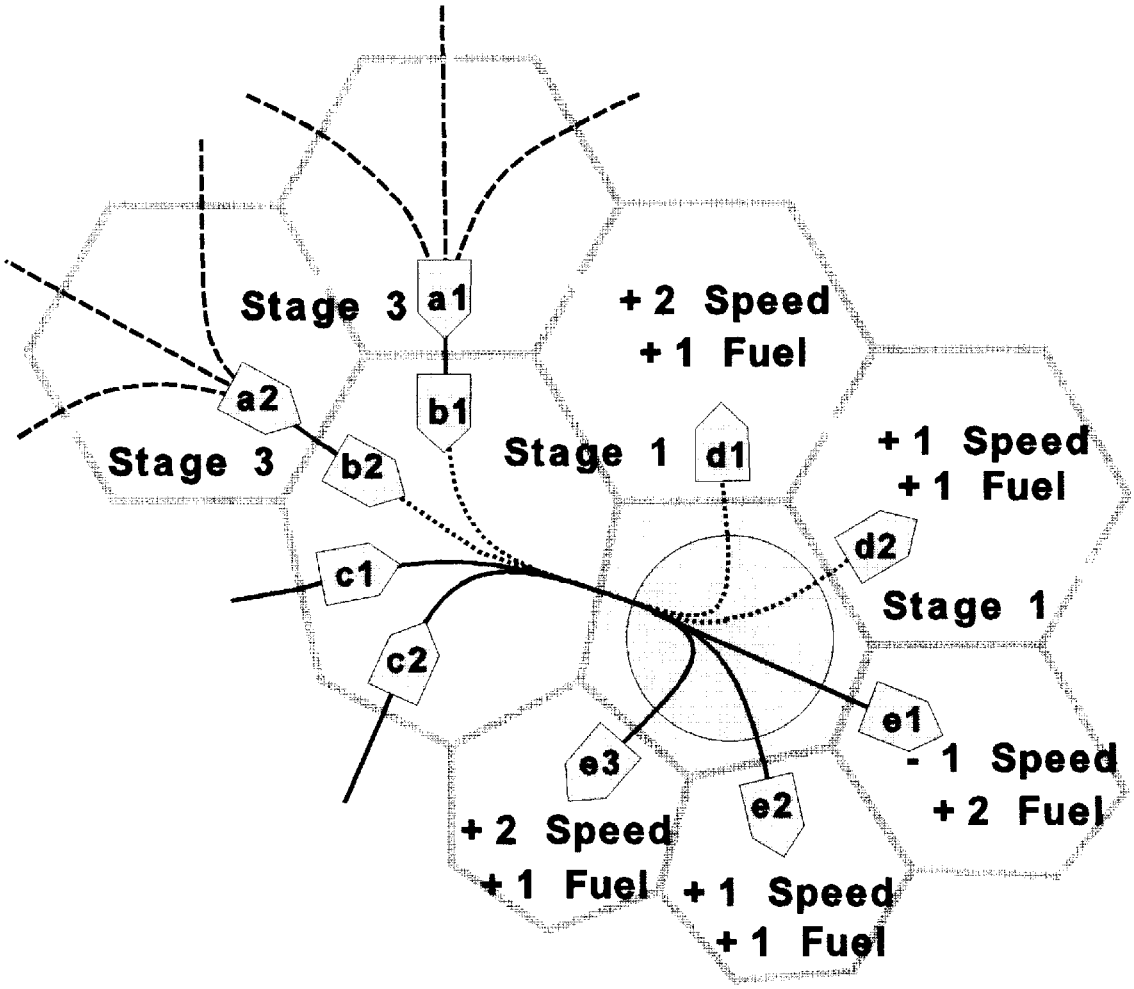
FIG. 21A is a diagram from the game rules instructing multiple game board configuration spacecraft marker velocity changes resulting from planetary traversal using positions beginning in the interboard region, subsequently crossing an intraboard heptagon and ending in either the intraboard or interboard region.

A specific example of the exchange of fuel for speed in the context of a planetary encounter is the case of a spacecraft in a parabolic orbit that must change to another parabolic orbit in a maneuver such as that depicted in FIGS. 19A,B cases c1–c4, to approach a middle planet using a requisite initial position such as depicted in FIG. 17. An additional characteristic of the maneuver is that the spacecraft has fuel 4 and speed 2 and the planet is two polygons distant and scheduled to advance at the beginning of the next round of play. Therefore, the spacecraft's speed is first advanced one unit to 3 with a corresponding decrease of its fuel to 3, designating the expenditure of fuel to accelerate the spacecraft and accomplished with corresponding changes of array markers to fuel 3 and speed 3. Now the spacecraft has sufficient speed to traverse the planet in one turn, but it still must execute the parabolic to parabolic orbit change depicted in FIGS. 19A,B cases c1–c4. As indicated in the figure, that necessitates the spacecraft's fuel marker being decremented 2 units from the 3 units existing after the speed increase, leaving a fuel 1 marker in the array. Thus, the spacecraft with speed 3 traverses the planet to a contiguous polygon, selecting a path designated in FIG. 17 that accelerates the spacecraft one speed unit. Therefore, the maneuver's last requirement is the replacement in the array of a speed 3 marker for a speed 4 marker, which new speed the spacecraft uses on the next player turn. Subsequent the maneuver the spacecraft's array column indicates fuel 1 and speed 4. The player will want to visit an outer planet to increase that spacecraft's fuel.

XXXII. The Differentiated Powers of Spacecraft Classes

Spacecraft of primary, secondary, and tertiary classes have increased cargo capacity, able to transport using the device of their array column two, four, and six resource markers respectively. Spacecraft also have in increasing order of their class increased immunity from some catastrophe and entropy events, designated in card instructions, and increased capacity to project that immunity to spacecraft and societies on polygons contiguous to that of their markers, which is represented in the case of protection projected over societies by using a planet marker coupled with the substitute external planet marker upon which the society marker is positioned. Such spacecraft capabilities are set forth in the game rules. In multistellar games, players who seek advantage in establishing societies on game boards other than their home game board, hosting their home station, may use hyperspace jump locations to traverse in single steps extensive polygonal paths.

XXXIII. The Grace Process

Beginning with the second round of player turns, each player as the first act of their turn selects an integer which is the sum of the faces of four tossed die and uses a table such as Table 1 to determine whether to draw from the catastrophe card deck. Then using card instructions FIG. 12A-#80,#81,#82, #83,#84 the player determines whether a playing piece has been impaired, and if so commences the impairment condition FIG.12A-#85. All other players then use the card's instructions FIG.12A-#86,#87 to determine whether a Grace decision is incumbent upon them. Then this sequence of acts and decisions is repeated with regard to the entropy deck. On the subsequent turns of each player for whom a Grace decision was incumbent, that player commences the movement or exchange of playing pieces which implements their decision. When a player makes a decision causing a Grace level increase, their Grace marker in their array is replaced with a marker with an incremented integer. Alternatively, when a player makes a decision causing a Grace level decrease, their Grace marker is replaced with a marker with a decremented integer.

XXXIV. Planet Rotation Synchronization and Its Governance of Resource and Knowledge Distributions from Societies The methods of synchronizing planet advances upon either unenumerated or enumerated game boards simulate planets whose orbital periods vary according to their distance from their star. Using the unenumerated game board, beginning each round of play subsequent the first, the planets are advanced in their orbit according to the schedule: (1) the innermost planet advances one polygon on each turn, (2) the two middle planets advance one polygon every other turn, and (3) the two outer planets advance one polygon every third turn. A player must be designated to note with pencil and paper the passage of second and third turns. On every third turn the presence of society markers on external planet markers causes to be distributed to their players from a central store resource markers and knowledge points in the three knowledge categories, the increments achieved by replacing in their array positions knowledge markers for markers with higher numerals. This pattern of planet advances and resource and Knowledge distributions is maintained in games using the enumerated game board, except that the middle planets are advanced every time the inner planet lands upon a polygon labeled with an integer divisible without remainder by two, and the outer planets are advanced every time the inner planet lands upon a polygon labeled with an integer divisible without remainder by three. It is the advance of the outer planets that causes, according to the presence of society markers on external planet markers, distribution of resource markers and knowledge points from a central store.

XXXV. The Varieties of Player Capital and the Exchange of One Form for Another

Each player's collection of spacecraft, society markers, resource markers, and knowledge points constitutes their capital, and players are free to exchange that capital according to their interests. For example, a player may exchange some number of resource markers accumulated upon an external planet marker for the use of another player's spacecraft to transport some number of additional resource markers to another external planet marker, where the hiring player might need those resource markers to establish a society marker. Another example would be a player who has drawn an entropy card whose instructions threaten a society marker and which player lacks the knowledge points designated on the entropy card to avoid the impairment. That player might negotiate with another player, exchanging resource markers for the latter player's knowledge points to achieve the knowledge triple required by the entropy card to avoid the impairment. The purchasing player's knowledge marker levels are accordingly incremented, but the selling player's knowledge marker levels are not changed because knowledge is not lost when it is distributed. The Grace ramifications for such deals are explicated in a list of general conditions included in the game rules. If the selling player had instead donated the knowledge without remuneration that player would benefit an increment of their Grace level.

XXXVI. The Cyclical Collective Contribution of a Player's Society Markers to Their Three Knowledge Categories Each society marker a player has established upon an external planet marker generates some mix of the three knowledge category points at regular intervals of play rounds (the resulting knowledge level increments achieved by replacing in their array positions current knowledge markers for markers with higher numerals). At that time the three categories of knowledge points generated by all of a player's society markers are summed according to category and those sums for each category are used to increment the corresponding knowledge marker levels of each category (the player's knowledge triple) in the player's array.

XXXVII. The Game Winner

When the condition of play cessation agreed upon at a game's commencement occurs, the players' duplex scores (in unistellar games) or teams' duplex scores (in multistellar games) are calculated and the game winner declared.

XXXVIII. Computer Network Implementation

The implementation of Starworlds Synergy on a computer network, whereby players at separate computer stations interact in real time using graphical representations on their monitors and information shared across the network, is readily apparent.

What is claimed is:

1. A game apparatus for use by a plurality of players that simulates intrastellar and interstellar navigation and economic development subordinate to a universal moral order, thereby effecting synergy between the players' advancement of each's economic interests and the players' sacrifices for the advancement of others, and comprising:

a planar game board means having the shape of a regular hexagon whose center is the common center of a plurality of concentric rings of contiguous hexagons tessellated within and between rings, the outermost of which concentric rings contains six non-hexagonal polygons equiangularly positioned about the common center, enabling the outermost ring to tessellate with linearly contiguous polygons tessellating said game board's six sides, which boundary polygons conjoin with the boundary polygons of a second, congruent and identically tessellated, adjacently placed said game board means, aligning vertex to vertex any side of one game board to any side of the other, to form a row of regular hexagons along the shared edge; thereby enabling a plurality of said game boards to be tessellated in a manner extending without interruption the internal, concentric polygonal paths of one into the identical internal, concentric polygonal paths of another, whereby the interrelation of adjacent stellar gravitational fields, universally spherical in structure, is cross-sectionally simulated;

a plurality of planet marker means, wherein each said planet marker is advanced within one of said concentric rings according to predetermined pattern and synchronization;

a plurality of spacecraft marker means, wherein each said spacecraft marker is distinguished according to player, wherein each said player's collection of spacecraft markers are distinguished according to class, wherein the player's spacecraft of particular said class are individually distinguished;

a plurality of planetary resource marker means, wherein each said resource marker is distinguished according to resource variety;

a plurality of player parameter display means, one for each player, wherein each said parameter display comprises:

(a) spacecraft identity markers, each of which identifies one said spacecraft marker in play on the game board, and (b) for each said identity marker additional said display elements comprising speed markers, fuel markers, and resource markers, whereby the speed, fuel, and resource cargo of each spacecraft marker in play is disclosed for all players to know;

a navigation means, including player discretion, governing the interaction between said spacecraft markers, said central star figure, said contiguous paths of polygons, and said planet markers wherein spacecraft marker trajectory consisting of position and orientation upon the game board, spacecraft marker speed, and spacecraft marker fuel are altered with predetermined pattern and, according to other predetermined patterns, not altered;

a plurality of player grace marker means, wherein each said grace marker is distinguished according to player grace level, wherein each player's grace level determined by their decisions to assist and not assist other players is represented, whereby the morality accruing to an interstellar civilization from its member's collective decisions regarding the members of other civilizations is represented;

a plurality of society marker means wherein each said society marker is distinguished according to society complexity;

a plurality of knowledge marker means, wherein each said knowledge marker is distinguished according to varied knowledge category and level for each said category;

said player parameter display means further comprising (a) said grace markers and (b) said knowledge markers;

a plurality of instructions, each designating a distinct impairment of specific said classes of spacecraft markers and society markers of specific said complexity, coupled with a game rule requiring, in the circumstance that a player receives one of said instructions, other players, when predetermined criteria are fulfilled, must decide whether to use their own game markers comprising spacecraft markers, society markers, and knowledge markers to release said instruction receiving player from impairment of their game marker, whereby one player choses to assist another;

a frequency distribution over a range of numbers and a random function device generating said distribution and for the distribution a plurality of mappings between said moral levels and said numbers in the frequency distribution's domain, wherein the mappings determine whether a player receives said impairment instruction;

said spacecraft marker classes differentiated according to capabilities, comprising:

(a) number of said resource markers a spacecraft marker can transfer between game board areas using said player parameter display means, whereby spacecraft cargo capacity is simulated, (b) immunity from said instructions of impairment, (c) projection of said immunity from impairment over other spacecraft markers and society markers;

said knowledge markers of different category and level for each category forming a knowledge tuple for each player, and each said impairment instruction including a knowledge tuple to which the instruction receiving player compares their knowledge tuple to determine whether each knowledge category level constituting their tuple is equal to or greater than the impairment instruction's tuple's corresponding knowledge category level, the occurrence of said multiple inequality for all said category levels resulting in the player avoiding the impairment instruction, whereby is simulated a society's use of knowledge to preserve itself by preparing for and thereby avoiding destructive events and by recovering from destructive events;

a plurality of external planet marker means, one for each said planet marker, positioned apart from said game board, wherein each said external planet marker is partitioned by indicia into areas associated with each player, wherein each said partitioned is used to display said society markers and said resource markers belonging to its said associated player, wherein each external planet marker is associated with a distinct planet marker and that planet marker's said distinct resource, whereby a stationary platform is obtained for planet markers revolving upon the game board, whereby commerce transacted on particular planets is simulated;

said spacecraft markers, society markers, resource markers, and knowledge category levels exchanged between players according to practices sometimes fixed by player agreement at a game's beginning, sometimes negotiated freely between players at the time of exchange, and sometimes fixed by players having achieved on one or more said external planet markers society markers of predetermined complexity, wherein the sale of knowledge category level does not reduce the seller's said category level because knowledge is not lost when distributed, whereby is simulated capital markets;

each said society marker after its establishment on said external planet marker causing to be distributed to its player on predetermined play rounds resource markers and knowledge level increments in some mix of said knowledge categories, whereby is simulated the production of materials and knowledge by societies;

said game board used tessellated with a plurality of additional congruent and identically tessellated game boards and said game board used singly, without tessellation with additional game boards; whereby respectively is simulated multiple and single stellar systems;

said single game board configuration and said tessellation of a plurality of game boards having predetermined hyperspace jump polygons between which said spacecraft markers can move in one step regardless of the number of polygons between them composing one of said contiguous polygon paths;

whereby is simulated three dimensional euclidian space folded upon itself in a higher dimension and forming hyperspace jump locations where those folds coincide in euclidian space;

said hyperspace jump locations represented by hyperspace jump markers, wherein said hyperspace jump markers are positioned upon varying said intraboard and interboard polygons;

said multiple game board configuration having rules comprising:

(a) synchronization of player turns that are sequential in the context of player turns on a single game board and simultaneous in the context of said sequenced player turns on one game board progressing independent of sequenced player turns on another game board, and (b) an alternative synchronization of player turns upon all game boards coordinated by the simultaneous advancement of planets on all game boards, whereby is enabled the plotting of complex spacecraft marker trajectories involving traverses of planet markers on multiple game boards, whereby is simulated spacecraft trajectories in multistellar planetary systems;

a mathematical formula yielding a number, the independent variable, as a function of two dependent variables: grace level and knowledge level; which independent variables, calculated for each player, are the scores determining the game winner, whereby is simulated compassion's amplification of knowledge to establish the supreme society.

2. A game as in claim 1 wherein said game board means is three dimensional, having an upper surface, lower surface, and six sides, wherein said tessellation of any two game boards of said plurality thereof requires said aligning vertex to vertex and conjoining of any side of one game board with any side of the other.

Figure 13B:
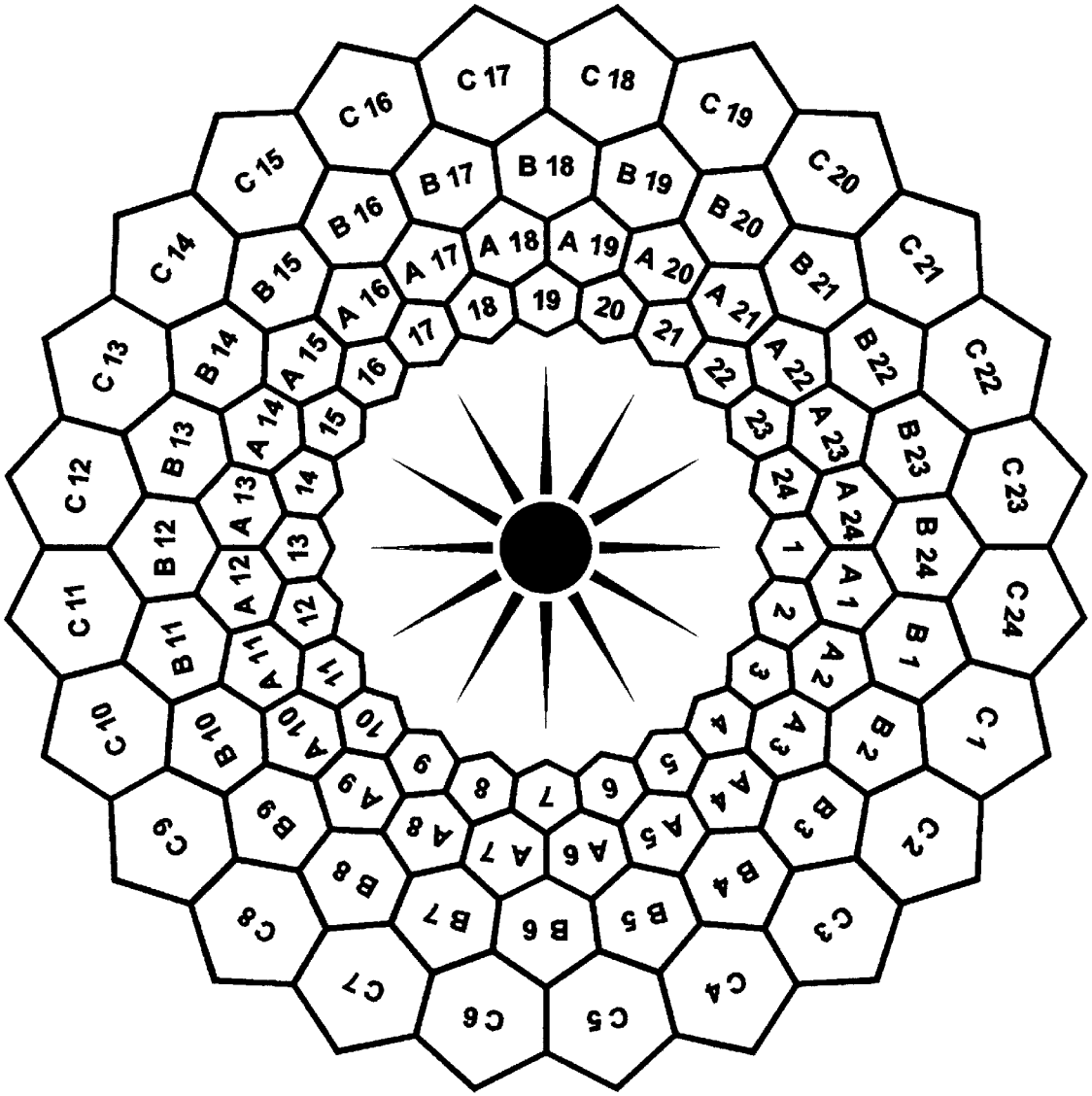
FIG. 13B is a sectional view of FIG. 13A that illustrates the idicia for polygons forming the innermost four rings.

3. A game as in claim 1 wherein some said game board polygons are distinguished by indicia;

wherein FIG. 13 demonstrates one possible use of letters and numbers for said indicia.

4. A game as in 3 wherein the indicia of said enumerated game board are used in conjunction with a random function device to determine said game marker impairment parameters comprising:

(a) impacted areas of said catastrophic natural phenomena and entropic failures, and (b) the boundary of an area around an instruction impaired spacecraft marker, society marker, or both that demands of each other player with a society marker, spacecraft marker, or both within said boundary said decision whether to assist the player with impaired game marker, wherein the decision to assist accrues to the deciding player an increased said grace level and a decision to not assist accrues to the deciding player a decreased grace level.

5. A game as in claim 1 wherein said six non-hexagonal equiangularly positioned polygons in a game board's said outermost concentric ring are heptagons.

6. A game as in claim 1 wherein said player parameter display means is an array easle comprised of ledges FIG. 5A upon which markers may be placed;

wherein said grace markers are distinguished by color and indicia and shaped to fit on a ledge of said array and wherein each said grace level is distinguished by a numeral;

wherein said knowledge markers are shaped to fit on said array and wherein said knowledge markers of varied category are distinguished by color and indicia and wherein said knowledge level for each said category is distinguished by a numeral;

wherein said resource markers are shaped to fit on said array ledges and within said player partitions of said external planet markers and wherein said varied resource markers are distinguished by color and indicia;

wherein said varied complexity society markers are distinguished by attributes comprising shape, color, and indicia and wherein said society markers are scaled to fit within said player partitions of said external society markers;

wherein said planet markers are disks distinguished by attributes comprising size and indicia according to the respective closeness of the ring within which each advances to that ring's said common center;

wherein said hyperspace jump markers are disks distinguished from other game markers by indicia and scaled to fit within predetermined polygons of said game board polygonal paths;

wherein said spacecraft markers are differentiated between players by color of their top surface half, between class by color of their bottom surface half, and between other members of their class for a particular player by numeral; wherein said spacecraft markers for said single game board configuration are differentiated by four said player colors; wherein said spacecraft markers for said multiple game board configuration comprising three adjacent game boards are differentiated by twelve said player colors wherein for each spacecraft marker in play upon the game board there is, for placement upon the ledges of said player parameter display device, (a) a marker identifying said spacecraft marker using color matching the spacecraft marker's class and using a numeral identical to that of the spacecraft marker's numeral, (b) a marker indicating with numeral said spacecraft marker's speed, wherein a spacecraft marker's speed can be changed by exchanging its said speed marker having one numeral with a speed marker having a different numeral, and (c) a marker indicating with numeral said spacecraft marker's fuel, wherein a spacecraft's fuel can be changed by exchanging its said fuel marker having one numeral with a fuel marker having a different numeral;

wherein a spacecraft marker's acquisition of fuel from a fuel resource planet is represented by increment of the numeral of its fuel marker;

whereby is simulated changes in spacecraft speed for any reason, expenditure of spacecraft fuel to adjust its speed, and spacecraft refueling.

7. A game as in claim 1 wherein said navigation means, including player discretion, comprises:

(a) game rules governing said spacecraft marker orientation and position upon said game board path polygons, (b) game rules governing substitution of said speed and fuel markers on said player parameter display device with respective speed and fuel markers with different numbers.

8. A game as in claim 1 wherein each said planet marker has associated with it one or more said resources, wherein at least one said resource is unique to that planet marker, defining that planet marker's said resource variety;

wherein planet markers are distinguished according to resource varieties comprising:

(a) spacecraft fuel, (b) energy, (c) ecological, and (d) mineral;

wherein said spacecraft acquisition of fuel is displayed with said spacecraft fuel marker and said energy, ecological, and mineral resources each have an associated said resource marker;

wherein a player's spacecraft marker's traversal of said planet marker results in the spacecraft marker acquiring one or more resource markers of the type associated with that planet marker;

wherein the resource marker is placed beneath said spacecraft identity marker in said player parameter display device;

wherein the resource markers may be removed from the player parameter display device and placed upon an external planet marker when the spacecraft marker traverses said external planet marker's said associated planet marker;

wherein the spacecraft marker trajectory coupled with adjustments of said player parameter display device represent a spacecraft marker's transfer of resource markers from one game board area to another;

whereby is simulated an interplanetary expeditions' initial procurement of resources and spacecraft transport of resources to exchange in said capital markets.

9. A game as in claim 1 wherein said common center of concentric rings of contiguous polygons is occupied by a star figure composed of a circle from which rays project;

said rings of concentric hexagons and said outermost concentric ring form said circular and paracircular paths FIGS. 19A,B;

said rings of concentric hexagons used in conjunction with said central star figure form said parabolic paths FIGS. 19A,B;

wherein said rays and spaces between rays are used to trace parabolic paths across the not tessellated central region occupied by the star figure.

10. A game as in claim 1 wherein said spacecraft marker's different possible said polygonal paths entering upon and leaving a polygon occupied by said planet marker result in correspondingly distinct adjustments of the spacecraft marker's said speed without reduction of the spacecraft marker's said fuel;

wherein a spacecraft marker's velocity, which includes both speed and direction components, may be changed by exchanging some combination of the velocity's speed and direction elements for fuel;

wherein a spacecraft marker may advance upon any one said circular, parabolic, and paracircular path indefinitely without change of speed and fuel;

wherein a spacecraft marker's specific deviations from a circular, parabolic, and paracircular path and also deviation from a path extending between any two said conjoined game boards require according to deviation type predetermined actions comprising reduction of fuel or no fuel reduction;

whereby is simulated (a) spacecraft use of planets to alter velocity without fuel expenditure, (b) stable spacecraft orbits of one star or multiple stars, and (c) spacecraft fuel expenditure to deviate from stable orbits.

11. A game as in claim 1 wherein, in a player's decision to assist a player receiving said impairment instruction the assisting player increases their grace level and in a player's decision to not assist a player receiving impairment instruction the not assisting player decreases their grace level;

wherein said grace level increases and decreases are represented by respective increases and decreases of the player's said grace marker numeral;

whereby the game simulates transformation of an interstellar civilization's morality determined by its members' collective decisions regarding members of other civilizations.

12. A game as in claim 11 wherein said plurality of distinct instructions are of two varieties: one describing a catastrophic natural phenomena uninfluenced by human action and the second describing an entropic failure of a human created system or device;

wherein said plurality of distinct instructions partitioned into two varieties is implemented using two card decks, one deck for instructions regarding catastrophic natural phenomena and the second deck for instructions regarding entropic failure.

13. A game as in claim 12 wherein each said catastrophe card has printed on it a destructive natural phenomena and a selection of information from the group comprising:

(a) the destruction level, (b) the type of said game marker impaired: spacecraft marker or society marker, (c) the method used to determine the impact area of said destruction, determining what game markers are affected, (d) the minimum score for each said level of distinct knowledge category a player must have to avoid any of their game marker's in said impacted area being affected, wherein the group of knowledge category levels constitute a player's knowledge tuple, (e) impairment description, and (f) the method used to determine which other players are eligible to either (1) increase their said grace level if they use some collection of their game markers including one game marker to aid the player with said instruction impaired game marker, or (2) decrease their grace level if they do not use said collection of game markers to aid the player with impaired game marker;

wherein each entropy card has printed on it an entropic failure and a selection of information from the group comprising:

(a) the failure level, (b) the type of said game marker impaired: spacecraft marker or society marker, (c) the method used to determine the impact area of said failure, determining what game markers are affected, (d) the minimum score for each said level of distinct knowledge category a player must have to avoid any of their game marker's in said impacted area being affected, wherein the group of knowledge category levels constitute a player's knowledge tuple, (e) impairment description, and (f) the method used to determine which other players are eligible to either (1) increase their said grace level if they use some collection of their game markers including one game marker to aid the player with said instruction impaired game marker, or (2) decrease their grace level if they do not use said collection of game markers to aid the player with impaired game marker.

14. A game as in claim 1 wherein is specified a cumulative distribution over a range of numbers and a random function device generating said distribution and for said distribution a plurality of mappings, Tables 1,2,3 for example, each consisting of a set of pairings of each grace level, the first pair number, with a number from the frequency distribution domain, the second pair number, for example in Table 1 the set of pairings of integers in column 1 with the integers in column 3, wherein each said mapping is distinguished by a unique shifting of said set of pairs' said second pair numbers, said shifting consisting of either increment or decrement when contrasted with the shifting of another said mapping;

wherein said mappings are used to decide whether a player receives said impairment instructions;

wherein said mappings are distinguished by the frequency that players receive impairment instructions for each grace level, wherein one of said mappings is selected by players at a game's beginning and used exclusively throughout the game;

wherein the frequency of receipt of impairment instructions by all players is selected;

whereby the simulated universal moral order is parameterized and its clement-punative degree selected.

15. A claim as in 14 wherein each said mapping consisting of a set of pairings of each grace level with a number in the frequency distribution domain is further differentiated between a type one mapping and a type two mapping, wherein for the type one mapping, between two sequential said pairs ordered according to grace level there is less change in the pair's second numbers, the frequency distribution domain numbers, than there is change in the second numbers of sequential pairs, also ordered according to grace level, occuring in the type two mapping;

wherein Table 1 demonstrates one said mapping in which the set of pairings of integers in column 1 and integers in column 3 exemplify a type one mapping and the set of pairings of integers in column 2 and integers in column 3 exemplify a type two mapping;

wherein for each grace level a random function device's selection of an integer equal to or greater than a specified integer in the frequency distribution's domain results in a player with that grace level receiving said instruction of impairment;

wherein that receipt of impairment instructions is decreasedly influenced by a player's grace level for a type one mapping than said receipt of impairment instructions is influenced by a type two mapping;

whereby is simulated a moral order in which entropic failure of human created systems and devices are more influenced in the selection of their victims by those victims' moral histories than natural catastrophes are so influenced.

16. A game as in claim 1 wherein each player's said knowledge level variable used to determine a game winner is the summation of that player's said knowledge category levels constituting their said tuple and wherein each player's said grace level variable used to determine a game winner is the numeral of that player's said grace marker.

17. A game as in claim 1 wherein each said particular category knowledge marker has thereon a numeral indicating that particular knowledge category level, wherein said distribution to a player on predetermined play rounds of some mix of increments to each of that player's knowledge category levels commences when that player establishes one said society marker of predetermined complexity type on said external planet marker, each society marker type distributing to its player thereafter on predetermined play rounds a distinct mix of increments to each of that player's knowledge category levels; wherein for each player each particular category knowledge marker is originated only once in a game by the establishment of one society marker of predetermined type, whereafter each of a player's knowledge category levels is incremented on the predetermined play rounds by the sum of those category levels distributed by each of a player's society markers.

18. A game as in claim 1 wherein each said planet marker has associated with it one said resource, wherein the resource is represented by a distinct said resource marker;

wherein the establishment of said minimal complexity society marker upon said external planet marker requires said transfer by said spacecraft marker to said external planet marker at least one resource marker of each variety not associated with the external planet marker, the transfer achieved using said method of the spacecraft marker in conjunction with said parameter display device;

wherein the presence of varied resource markers on the external planet marker permits the player to exchange those resource markers for a minimal complexity society marker;

wherein the exchanged resource markers are returned to a central store;

wherein the establishment of a minimal complexity society marker requires the transfer of resource markers from other resource planet types;

whereby capital acquisition necessitates interplanetary navigation by cargo carrying spacecraft.

19. A game as in 18 wherein a player may establish said second-most complex society marker upon said external planet marker when the player has previously placed upon the external planet marker at least two said minimally complex society markers, exchanging the minimally complex society markers for one second-most complex society marker, wherein the minimally complex society markers are returned to a central store;

wherein a player may place said third-most complex society marker upon an external planet marker when the player has previously placed upon the external planet marker at least two second-most complex society markers, exchanging the second-most complex society markers for one third-most complex society markers, wherein the second-most complex society markers are returned to a central store;

wherein the cost of one second-most complex society marker is at least two minimally complex society markers, and the cost of one third-most complex society marker is at least two second-most complex society markers;

whereby the establishment of increasingly complex societies necessitates the acquisition of proportionately greater amounts of resources.

20. A game as in claim 1 wherein each said society marker distributes to its player on predetermined play rounds said resource markers of the type associated with the external planet marker upon which that society marker is positioned;

wherein said second-most complex society marker generates more resource markers on the predetermined play rounds than said minimal complexity society marker and said third-most complex society marker generates more resource markers on said predetermined play rounds than the second-most complex society marker;

whereby is simulated the proportionately greater wealth production of more elaborate societies.

21. A game as in claim 1 wherein each said society marker distributes to its player on predetermined rounds of play and proportionate to the society marker's complexity some predetermined mix of increments to the player's said knowledge category levels, which latter form collectively said knowledge tuple;

wherein the total increment, summed across categories, of said second-most complex society marker's distribution to its player's knowledge tuple is greater than said total increment of said minimal complexity society marker's distribution, and the total increment of said third-most complex society marker's distribution to its player's knowledge tuple is greater than the total increment of the second-most complex society marker's distribution;

whereby is simulated the contribution of planetary settlements of varying elaboration to their overall society's knowledge, whereby increasingly complex societies contribute proportionately more knowledge.

* * * * *

UNITED STATES PATENT AND TRADEMARK OFFICE

CERTIFICATE OF CORRECTION

PATENT NO. : 5,906,372

DATED : May 25, 1999

INVENTOR(S) : Recard

It is certified that error appears in the above-identified patent and that said Letters Patent is hereby corrected as shown below:

Column 4, line 20, "and P1 (b) trajectory" should read -- and (b) trajectory--.
Column 11, Table 2, "blank space, 6, 14, 48" should read -- 6, 6, 14, 48--.
Column 11, line 29, "distribution identifying for reach integer" should read -- distribution identifying for each integer--.

| Col. | Line | | |
|---|---|---|---|
| 9 | 61 | **2** | 2 |
| 9 | 62 | **3** | 3 |
| 9 | 62 | **4** | 4 |
| 9 | 64 | **C1** | C1 |
| 9 | 65 | **C2** | C2 |
| 9 | 66 | **C3** | C3 |
| 10 | 2 | **1** | 1 |
| 10 | 5 | **5** | 5 |
| 10 | 11 | **7** | 7 |
| 10 | 28,29 | **1-A, 2-B, 3-C, 4-D, 5-E, 6-F** | 1-A, 2-B, 3-C, 4-D, 5-E, 6-F |
| 10 | 45 | **1,2-M, 3,4-E, 5,6-B** | 1,2-M, 3,4-E, 5,6-B |
| 10 | 53 | **1** | 1 |

UNITED STATES PATENT AND TRADEMARK OFFICE

CERTIFICATE OF CORRECTION

PATENT NO. : 5,906,372
DATED : May 25, 1999
INVENTOR(S) : Recard

It is certified that error appears in the above-identified patent and that said Letters Patent is hereby corrected as shown below:

| Col. | Line | | |
|---|---|---|---|
| 10 | 57 | **C2** | C2 |
| 17 | 9 | **7** | 7 |
| 17 | 18 | **1** | 1 |
| 17 | 23 | **7** | 7 |
| 17 | 25 | **5** | 5 |
| 18 | 21 | **c1-c4** | c1-c4 |
| 18 | 24 | **4** | 4 |
| 18 | 24 | **2** | 2 |
| 18 | 30 | **3** (two occurrences) | 3 (two occurrences) |
| 18 | 33 | **c1-c4** | c1-c4 |
| 18 | 36 | **1** | 1 |
| 18 | 37 | **3** | 3 |
| 18 | 41 | **3** | 3 |

UNITED STATES PATENT AND TRADEMARK OFFICE

CERTIFICATE OF CORRECTION

PATENT NO. : 5,906,372
DATED : May 25, 1999
INVENTOR(S) : Recard

It is certified that error appears in the above-identified patent and that said Letters Patent is hereby corrected as shown below:

| Col. | Line | | |
|---|---|---|---|
| 18 | 41 | **4** | 4 |
| 18 | 43 | **1** | 1 |
| 18 | 44 | **4** | 4 |

Signed and Sealed this

Thirtieth Day of November, 1999

*Attest:*

*Attesting Officer*

Q. TODD DICKINSON

*Acting Commissioner of Patents and Trademarks*